US012379186B2

(12) United States Patent
Hetzel et al.

(10) Patent No.: US 12,379,186 B2
(45) Date of Patent: Aug. 5, 2025

(54) ADJUSTABLE SIGHT ASSEMBLY

(71) Applicant: Heckler & Koch GmbH, Oberndorf/Neckar (DE)

(72) Inventors: Markus Hetzel, Epfendorf (DE); Stefan Thimm, Hardt (DE)

(73) Assignee: HECKLER & KOCH GMBH, Oberndorf (DE)

( * ) Notice: Subject to any disclaimer, the term of this patent is extended or adjusted under 35 U.S.C. 154(b) by 21 days.

(21) Appl. No.: 17/966,507

(22) Filed: Oct. 14, 2022

(65) Prior Publication Data

US 2023/0124745 A1 Apr. 20, 2023

(30) Foreign Application Priority Data

Oct. 15, 2021 (DE) ..... 10 2021 005 161.0

(51) Int. Cl.
*F41G 1/033* (2006.01)
*F41G 11/00* (2006.01)

(52) U.S. Cl.
CPC ..... *F41G 1/033* (2013.01); *F41G 11/004* (2013.01)

(58) Field of Classification Search
CPC ..... F41G 1/033
See application file for complete search history.

(56) References Cited

U.S. PATENT DOCUMENTS 4,654,993 A 4/1987 Atchisson
4,686,770 A 8/1987 Aigner
7,814,698 B2 10/2010 Fluhr et al.
10,663,253 B1 5/2020 Geissele et al.
2005/0188602 A1 9/2005 Swan
2009/0038202 A1 2/2009 Nemec
(Continued)

FOREIGN PATENT DOCUMENTS

CN 110230950 9/2019
DE 39 38 797 5/1991
(Continued)

OTHER PUBLICATIONS

German Patent Office, "Office Action", issued in connection with German Patent Application No. 10 2021 005 161.0, issued on Jul. 28, 2022, with English Translation, 20 pages.
(Continued)

*Primary Examiner* — Jonathan C Weber
(74) *Attorney, Agent, or Firm* — HANLEY, FLIGHT & ZIMMERMAN, LLC

(57) ABSTRACT

In one example, the disclosure relates to adjustable flip up sight assembly that can be adjusted vertically and laterally in particular, for an automatic firearm, comprising a front sight support element that is supported by an axle on a mount, in particular such that they can pivot thereon, wherein the front sight support element has an adjustment element supported on a spring element and releasably connected to a front sight, which contains a keyhole type opening through which the axle is inserted, wherein the adjustment element can be moved in relation to the axle against the spring force between two positions inside the front sight support element such that the keyhole opening prevents a lateral movement of the front sight support element along the axle when engaged with the axle, and allows the lateral adjustment of the front sight support element in a released position.

12 Claims, 18 Drawing Sheets

(56) References Cited

U.S. PATENT DOCUMENTS

| | | | | |
|---|---|---|---|---|
| 2009/0241400 | A1 | 10/2009 | Stumpp | |
| 2010/0005697 | A1* | 1/2010 | Fluhr | F41G 1/08 42/111 |
| 2017/0350674 | A1 | 12/2017 | Odle et al. | |
| 2018/0306552 | A1 | 10/2018 | Kung et al. | |
| 2019/0011223 | A1 | 1/2019 | Odle et al. | |

FOREIGN PATENT DOCUMENTS

| | | |
|---|---|---|
| DE | 20 2006 011 918 | 11/2006 |
| WO | 2008092668 | 8/2008 |

OTHER PUBLICATIONS

Japan Patent Office, "Notice of Reasons for Refusal," issued in connection with Japanese Patent Application No. 2022-165236, dated Feb. 20, 2024, 5 pages. [English Translation Included].

European Patent Office, "Extended Search Report," issued in connection with European Application No. 22201617.2 on Jun. 7, 2023, 14 pages. [English Machine Translation Included].

European Patent Office, "Intention to Grant," issued in connection with European Application No. 22201617.2 on Nov. 22, 2024, 10 pages. [English language machine translation included.].

Japan Patent Office, "Notice of Reasons for Refusal," issued in connection with Japanese Patent Application No. 2022-165236, dated Jul. 9, 2024, 6 pages. [English language machine translation included.].

Japan Patent Office, "Written Opinion," issued in connection with Japanese Patent Application No. 2022-165236, dated Aug. 8, 2024, 3 pages. [English language machine translation included.].

Japan Patent Office, "Decision to Grant a Patent," issued in connection with Japanese Patent Application No. 2022-165236, dated Aug. 27, 2024, 5 pages. [English language machine translation included.].

Japan Patent Office, "Notice of Allowance," issued in connection with Japanese Patent Application No. 2022-165236, mailed on Aug. 27, 2024, 2 pages. [English language machine translation included.].

Canadian Intellectual Property Office, "Examiner Requistion," issued in connection with Canadian Patent Application No. 3,179,193, mailed on Oct. 22, 2024, 4 pages.

European Patent Office, "Decision on the grant of a European patent under Article 97(1) EPC," issued in connection with European Patent Application No. 2201617.2-1015 / 4224110, mailed on Feb. 6, 2025, 4 pages. [English language machine translation included.].

* cited by examiner

ADJUSTABLE SIGHT ASSEMBLY

RELATED APPLICATION

This patent claims the benefit of German Patent Application No. 10 2021 005 161.0, which was filed on Oct. 15, 2021. German Patent Application No. 10 2021 005 161.0 is hereby incorporated herein by reference in its entirety. Priority to German Patent Application No. 10 2021 005 161.0, is hereby claimed.

FIELD OF THE DISCLOSURE

This disclosure relates to an adjustable sight assembly for an automatic firearm. In some examples, the disclosed adjustable sight assembly includes a flip up sight that can be adjusted vertically and laterally. The disclosure also relates to a front sight support element for such a sight assembly and to axles and mounts for the sight assembly. The disclosure also relates to an automatic firearm equipped with such example sight assemblies.

BACKGROUND

Firearms often utilize adjustable sights to facilitate a marksman aiming a firearm at a target.

BRIEF DESCRIPTION OF THE DRAWINGS

Examples of the invention are explained in greater detail below in reference to the attached, drawings. Other examples are possible.

Figure 1:
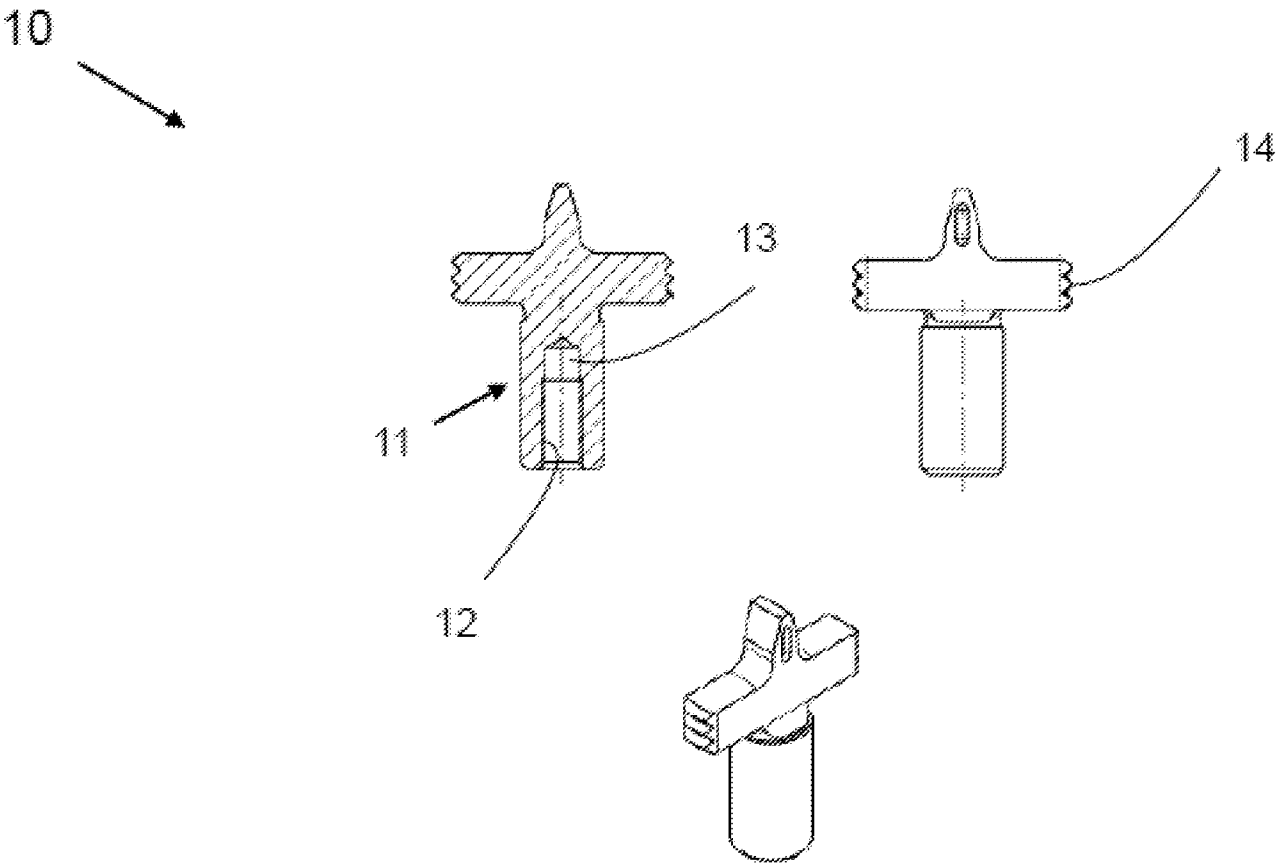
FIG. 1 shows an example front sight from numerous perspectives, which can be releasably connected to an adjustment element and be used in a sight assembly.

The structure and functioning of the adjustably sight assembly for an automatic firearm, and the automatic firearm that has this sight assembly shall be explained below in reference to the drawings. The drawings show examples of the invention. As such, the structure and functioning shall be explained in particular on the basis of a flip up sight that can be adjusted vertically and laterally.

For purposes of clarity, not all of the reference symbols are included in all of the drawings. The same reference symbols are used, however, in all of the drawings.

In these documents, position terms such as "up," "down," "front," "back," etc. relate to a firearm in which the bore axis is horizontal and shots are fired forwards, away from the shooter.

DETAILED DESCRIPTION

A pivotal front sight is shown in DE 39 38 797 A1 in which an adjustment screw is placed in the front sight with which the height of the front sight can be adjusted when it is upright. A sight known shown is in U.S. Pat. No. 4,686,770 in which the front sight can be adjusted laterally by turning an adjustment screw. The height of the front sight can be adjusted with a threaded pin.

A mounting bracket with a sight element is shown in WO 2008/092668 A1 that has an adjustment element, which can be switched from a sighting mode to an adjustment mode against a spring force, wherein the adjustment element is releasably secured to the sight element by a latching mechanism when in the sighting mode, and can be brought into various sighting modes when in the adjustment mode. WO 2008/092668 A1 also relates to a second mounting bracket, which has a second sight element that can be placed directly on a handguard on a firearm, and which can be pivoted about a pivot element from a standby position to an operating position, in which the second sight element has a retaining element that secures the sight element in the operating position transverse to the bore axis against a brace.

As described below, the examples disclosed herein create an alternative, adjustable sight assembly, in particular a flip up sight that can be adjusted vertically and laterally. In an example, a mechanical sight assembly is to be created that has fewer parts, is light and compact, and can be produced more easily. A mechanism for a sight assembly that prevents the sight assembly from being unintentionally shifted laterally, but allows for an intentional lateral movement in a user-friendly manner is also disclosed. Disclosed is also a front sight support element, an axle, and an adjustment element for the sight assembly. An automatic firearm may includes any of the example sight assemblies described herein.

In one example, a front sight support element is created for an adjustable sight assembly, in particular a flip up sight that can be adjusted vertically and laterally. The front sight support element may include a hollow element with a first section and a second section connected to the first section.

The first section of the front sight support element may be used for receiving a front sight. The second section may be used for receiving a spring element and an adjustment element that can be releasably attached to the front sight.

In some examples, there is at least one projection that extends radially inward between the first and second sections, which serves as a limit element for the front sight and as a stop for the spring element. The projection may be such that the adjustment device can move axially within the first and second sections of the front sight support element.

The front sight support element according some examples also contains at least one threaded hole in the second section. The axle can be received on this hole. The front sight support element may be a flip up sight, i.e. it can be folded up and down on a mount attached to the firearm. The threading may be specifically designed to transfer a rotation of the axle to the front sight support element. The axle has a threading that corresponds to that in the hole for this.

An adjustment element can be used with a front sight support element that is supported by a spring in the hollow front sight support element and can also be releasably attached to the front sight, e.g. by a threaded connection. Such a front sight support element can be folded up and down counter to the force of the spring element, i.e. pivoted about the rotational axis of the axle. Such a front sight support element also allows the front sight that is releasably attached to the adjustment element to move counter to and with the force of the spring element, such that the front sight can be moved from where it is snapped in place counter to the spring force, and can then be adjusted vertically by turning it, and subsequently returned to where it is snapped in place by the spring force. Such a front sight support element can also be supported on a threaded axle. The rotation of the axle can be transferred to the front sight support element therewith, and the front sight support element can then be moved to the right or left, depending on the direction in which the axle is turned.

In an example, the at least one inward extending projection is circular or annular and has a hole through which the adjustment element can be inserted.

In an example, the second section has a guide element at its axial end through which the adjustment element is guided, such that the adjustment element can be more easily moved in a controlled manner.

The guide element may be formed by axial slots on opposite sides of the second section. Opposing slots make it easy to control the movement of the adjustment element. The slots may also form openings through which a part of the adjustment element can extend, such that a stop is also formed that limits the movement of the adjustment element inside the front sight support element.

To further improve guidance and to also make it possible to easily produce the adjustment element, an example may include two axially opposed threaded holes for the axle, and the guide element is centered axially between these two threaded holes.

In an example, that the outer geometry of the hollow body has a polygonal circumference, preferably octagonal. A polygonal design is robust and makes it easier to form the slots forming the guide element. In particular, this facilitates the centering thereof, such that symmetry is maintained.

The first section may have at least one groove at its axial end, into which the front sight can be snapped in place. With a single groove, it is possible to snap the front sight in place in 180° increments. In an example, the first section has two grooves on its axial end that intersect at a right angle, into which the front sight can be snapped in place. Two grooves allow the it to be snapped in place in 90° increments. The grooves can have angular or circular cross sections. Angular and circular grooves can also be combined with one another. It is therefore advantageous when the groove that is parallel to the gun barrel has a circular cross section, e.g. in the form of a flattened U, while the groove that is at a right angle to the gun barrel has an angular cross section, which may be minimally larger than the thickness of the front sight, in order to prevent the front sight from slipping out unintentionally. As a result, the front sight can be removed in this arrangement by pulling it against the spring force, but not by twisting it out of the groove.

A second aspect of the disclosure relates to an axle for an adjustable sight assembly, in particular a flip up sight that can be adjusted vertically and laterally, which allows a front sight support element to be pivotally mounted on a mount. The body of the axle may have a profile that corresponds to the shape of an opening in the adjustment element, with which a torque can be transferred. The axle body also has at least one second threading with which a rotation can be transferred, wherein the second threading corresponds to the at least one first threading in the front sight support element.

The axle can be attached to the front sight support element such that a torque can be transferred, and it can be attached in a manner in which torque is not transferred. The adjustment element can be moved in relation to the axle, in particular at a right angle to the axle, with and against the force of the spring element.

In the torque-transferring connection, the front sight support element can be folded up and down, but not moved laterally. In the connection in which torque is not transferred, the front sight support element can be moved laterally. A rotation of the axially secured axle transfers this rotation to the threading on the front sight support element, such that it moves laterally.

In an example, the outer circumference of the profile is oriented along the circumference of the axle. The circumferential profile, extending in particular over a specific axial region of the axle facilitates the engagement with the first geometry and results in particular in a robust torque-transferring connection.

In a structurally simple example, the profile is formed by at least two, preferably four recesses on the axle body extending in the axial direction of the axle. Each recess may form a planar surface that is 90° to the adjacent planar surface. It has proven to be advantageous when the adjacent planar surfaces do not abut one another directly, and instead are separated by sections of the outer surface of the axle body. These sections of the outer surface then form rounded corners, so to speak.

This arrangement may result in a profile in particular with a square cross section that allows for a robust and reliable transfer of a torque, in that it is ensured that the torque is transferred via a planar surface and not a via a corner. This also increases the service life. The rounded corners further facilitate the engagement in the first geometry of the keyhole type opening in the adjustment element for establishing the torque-transferring connection.

In an example, the profile borders on threaded sections of the axle body in both axial direction of the axle, such that, in other words, the profile is located axially between two threaded sections, specifically a first and second threaded section. The threaded sections are intended to be threaded into the threading on the front sight support element, such that a rotation of the axle can be transferred to the front sight support element.

In an example, the two threaded sections form a single threaded section, i.e. the outer surface sections form a third profile section that joins the first and second profile sections such that a continuous threading is obtained. In other words, the four planar surfaces of the square cross section are separated by threaded corners.

With the use of the this profile with four planar surfaces, a thread may be first cut into the axle body, and the planar surfaces are subsequently milled. This makes it possible to produce the axle quickly, precisely, and inexpensively, and the continuous thread results in a reliable and precise adjustment of the front sight support element. It is also conceivable to first mill the profile, and then cut the threads.

In order to secure the axle on a mount, the axle can have a circumferential groove for a retaining ring, or a hole for a locking pin on one of its ends.

In an example, the axle has a slotted head for a tool at its other end, for the lateral adjustment of the front sight support element. A screwdriver or a coin or some other tool can be used for this.

In an alternative example, the axle has a gripping surface, in particular a knurled or ribbed knob, allowing the front sight support element to be adjusted laterally without tools. This example has proven to be particularly advantageous because the lateral adjustment can take place more quickly without tools, which is of particular advantage in combat situations. The lateral adjustment can therefore be made in that the front sight is pulled out against the spring force, and the knob is rotated with the right hand.

According to a third disclosed aspect, there is an adjustment element for an adjustable front sight, in particular a flip up sight that can be adjusted vertically and laterally. The adjustment element has a first section extending longitudinally, and a flat second section, which is connected to the first section. The first section also has a means for releasably connecting it to a front sight, which is preferably formed by a thread on an axial end of the first section.

The second section has a keyhole type opening through which an axle on which the front sight support element is supported is inserted, which is designed for a torque-transferring connection obtained with its first geometry, and prevents transfer of torque by the axle with a second geometry, i.e. forming a connection with the axle in which torque is not transferred.

This results in an adjustment element that serves as part of the assembly of the sight forming a snap-in system for preferably three different forms of adjustment, specifically the folding up and down, and the lateral and vertical adjustment.

The keyhole type opening is an example that is particularly important for the lateral adjustment because this keyhole opening makes it possible to move the adjustment element in relation to the axle, in particular at a right angle to the axle, to move the adjustment element either into engagement with the axle (engaged position) or out of engagement therewith (released position). The keyhole type opening is not necessary for the folding up and down, or for the vertical adjustment, but it is advantageous.

The engaged position corresponds to the position of the adjustment element in relation to the axle in which the torque-transferring connection is obtained. The front sight support element is in this position when it is folded up or down such that the front sight is snapped in place. It cannot be adjusted laterally in this position, because the keyhole geometry basically secures the profiled surface of the axle in place, such that a rotation of the axle is prevented.

The term, "torque-transferring connection" means that the adjustment element assumes a position in relation to the axle in which a torque can be transferred. This position prevents an unintended lateral adjustment of the front sight support element, and therefore the front sight. If it were attempted to rotate the axle about its own axis in this position, the keyhole type opening in the adjustment element would exert a counter-torque, preventing the lateral adjustment.

By pulling the front sight against to the spring force, the adjustment element is moved into the released position. The front sight support element (and therefore the adjustment element) can be adjusted laterally in this position, because this connection between the axle and adjustment element is not the torque-transferring connection, and therefore no torque can be transferred. The axially secured axle can then be turned manually or with a tool. This rotation is transferred to the front sight support element via the threaded coupling, which can then be moved laterally, i.e. in the axial direction of the axle.

It is advantageous when the circular section transitions into a straight section, which then transitions into the rectangular section after a certain axial extension. The straight section connecting the two shapes is preferably parallel, at least in part, to the rotational axis of the cylindrical body of the first section. The straight section is part of the first shape in particular.

The keyhole type opening can pass through the adjustment element particular, such that the axle supporting the front sight on the mount can pass through it. The keyhole type opening can be substantially formed by two geometric shapes, in particular a circular section and a rectangular section. This rectangular section can have rounded corners, in particular. Instead of a rectangular section, the second section can also be circular.

In an example, the end of the second section that is axially opposite the first section has rounded corners, with a first radius and a second radius that differs from the first. With rounded corners of different radii, an optimal interaction can be obtained between the adjustment element and the mount. In particular when the front sight is flipped up and down, the rounded corners make it possible to bring the adjustment element in contact with a ramp on the mount and for it to slide over the ramp. This contact takes place during the folding movement against the force of the spring element in particular, while the "sliding over" takes place with the force of the spring element. In particular when the lower corner of the second section has passed over the ramp with both of its radii, the adjustment element can "slide down," i.e. into a locked-in position, in which it is snapped in place.

According to a fourth disclosed aspect, there is a mount for a front sight support element that has a spring-loaded adjustment element. The disclosed example mount has a guide element which locks the adjustment element in place when the front sight support element is flipped either up or down.

This guide element is a permanent contact surface on the mount with which the force of the spring element is absorbed during the pivotal movement, i.e. the folding up and down, after which the adjustment element slides down and snaps in place with the force of the spring element, thus completing the flipping procedure.

In an example, the mount contains a base with two opposing tabs that are substantially perpendicular to the surface of the base, in which an axle for pivotally supporting the front sight support element is inserted, and the guide element is formed by a contact surface on the base between the tabs.

The contact surface can be at an angle to the base. The contact surface can also be parallel to the axle. This contact surface is preferably in the shape of a ramp, the sloped side of which faces the adjustment element. A sloped or angled contact surface advantageously allows the successive "engagements" of both rounded corners, i.e. engagement with the corner that has the smaller radii and with that which has the greater radii.

The mount may be attached to a gas block, or is an integral part thereof.

A fifth disclosed aspect includes an adjustable sight assembly, in particular a flip up sight that can be adjusted vertically and laterally, for an automatic firearm.

The sight assembly includes a front sight support element that is pivotally supported on an axle in a mount, wherein the front sight support element has spring-loaded adjustment element that is releasably connected to a front sight, which contains a keyhole type opening through which the axle is inserted. The adjustment element can move with and against the spring force in relation to the axle between two positions inside the front sight support element, such that the keyhole type opening prevents a lateral movement of the front sight support element along the axle in the engaged position, and allows the front sight support element to be moved laterally when in a released position.

In other words, the axle can be attached to the front sight support element such that a torque can be transferred and it can be attached such that torque is not transferred. The adjustment element can be moved in relation to the axis with and against the force of the spring element for this, in particular at a right angle to the axle.

In the torque-transferring connection, the front sight support element can be folded up and down, but it cannot move laterally. In the connection in which torque is not transferred, the front sight support element can be moved laterally.

A turning of the axially secured axle preferably transfers the rotational movement to a threading in the front sight support element, which then moves it laterally.

Such a front sight support element has a mechanism with which the front sight is secured against unintentional lateral movement while still allowing for intentional lateral adjustment in a user-friendly manner.

This "safety" can be released with the left hand by pulling up on the front sight, which can then be moved laterally, i.e. to the left or right, by a turning of the axle with the right hand. The keyhole opening is in the released position at this point. A "lateral adjustment of the front sight" refers to the lateral movement of the front sight support element, resulting in a movement of the front sight to the left or right. After the adjustment is completed, the front sight can be released. The spring element pushes the keyhole on the adjustment element into the engaged position on the axle. In this position, it is not possible to make lateral adjustments.

The examples described herein are advantageous because they can be easily produced from a technical standpoint, thus reducing the number of parts and the complexity of a flip up sight that can be adjusted vertically and laterally. Such a sight assembly is very compact and weighs less that sight assemblies from the prior art, e.g. the sight assembly for the MG5 machine gun. At the same time, it has a securing mechanism for lateral adjustment that can be easily manipulated in a user-friendly manner. The sight assembly can be used with numerous different automatic firearms, in particular machine guns and assault rifles.

It has proven to be the case that the sight disclosed example assemblies have significantly fewer parts than that used on the MG5 machine gun, for example.

The keyhole opening may pass entirely through the support element, such that the axle for supporting the front sight on the mount can be inserted through the hole. The keyhole opening can be formed substantially by two geometric shapes, in particular a circular section with a straight section, and a rectangular section, in which the width of the rectangular section is larger than the width of the straight section and the diameter of the circular section.

The body of the axle for the sight assembly preferably has a profile that corresponds to the geometry of the opening in the adjustment element such that when the adjustment element is in the engaged position, a torque that prevents lateral movement is generated when a turning of the axle is attempted, and it is only possible to make lateral adjustments when the adjustment element is in the released position.

The profile of the axle in the sight assembly may border on threaded sections on the body of the axle in both axial directions, wherein these threaded sections correspond to threaded holes in the front sight support element. A turning of the axially secured axle can be transferred to the front sight support element in an optimal manner via the threaded connection.

The front sight support element may have has a guide element for the movement of the adjustment element, resulting in better control of the movement of the adjustment element.

The mount may have a guide element with which the adjustment element is snapped in place when the front sight assembly support element is flipped up and when it is flipped down.

The sight assembly can be used with the front sight support element described above, for example. The sight assembly be used with the axle described above, for example. The sight assembly can be used with the adjustment element described above, for example. The sight assembly can be used with the mount described above, for example. The sight assembly can be used in particular with the front sight support described above, the axle described above, the adjustment element described above, and the mount described above.

The sight assembly may include the adjustment element described above, which is supported by a spring inside the front sight support element described above, and is releasably connected to a front sight. The sight assembly also comprises the mount described above, on which the front sight support element and the adjustment element are pivotally supported by the axle described above.

The spring element may be braced against a stop on the front sight support element, and exerts a force on the adjustment element in order to retain the front sight in a snapped-in or locked-in position. The spring element may be braced against the end surface of the projection on the front sight support element at its one axial end, and lies on a bearing surface on the second section of the adjustment element at its other axial end.

The front sight can be released from its snapped-in position, in which a turning of the front sight is prevented, by pulling against the spring force, moving it to a rotating position in which the front sight can be rotated in order to adjust its height.

A pulling of the front sight out of its snapped-in position also preferably results in a movement of the opening in the adjustment element in relation to the axle such that the adjustment element can be moved from a torque-transferring connection to the axle to a connection with the axle in which torque cannot be transferred, in order to move the front sight support element laterally, and this lateral movement of the front sight support element when the connection does not transfer torque is obtained by turning the axle secured axially to the mount, such that the rotation of the axle is transferred to the front sight support element by the threaded connection of the axle thereto, thus moving it laterally.

It also may be that the second section of the adjustment element can be brought at least in part in contact with the ramp in the mount during the pivotal movement when the front sight support element is flipped up or down, such that the adjustment element can be moved against the force of the spring element, wherein a movement of the adjustment element against the force of the spring element is only possible when in contact with the ramp to the extent that the torque-transferring connection between the axle and the front sight support element is continuously maintained during the pivotal movement.

A sixth disclosed aspect relates to an automatic firearm, in particular a machine gun or assault rifle, that is equipped with the sight assembly described above. Turning now to the figures, FIG. 1 shows a front sight 10 for a flip up sight assembly 70 that can be adjusted vertically and laterally, with a section 11 for an adjustment element 40 (FIG. 4), in which the section 11 also has a threading 12 that corresponds to the threading on the adjustment element 40. The section 11 extends longitudinally and has a blind hole 13 with an internal threading, into which the adjustment element 40 with the corresponding external threading is inserted. This sight is a front sight. Other forms are also conceivable.

Figure 2:
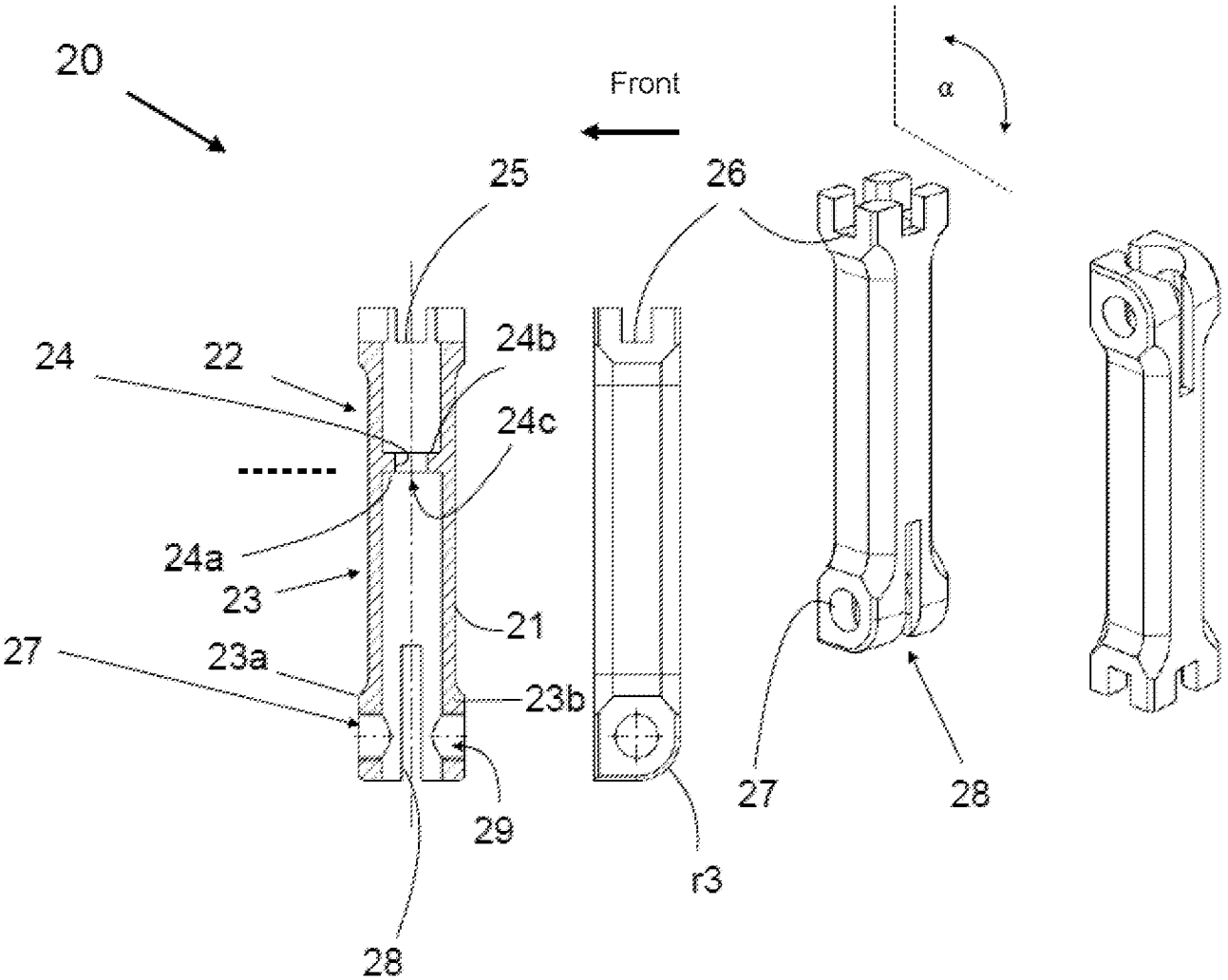
FIG. 2 shows from three perspectives and in a sectional view an example of a front sight support element.

FIG. 2 shows an example of a front sight support element 20 for a flip up sight assembly that can be adjusted vertically and laterally.

The front sight support element 20 has a hollow body 21 with a first section for receiving a front sight 10 and a second section 23 connected to the first section 22 for receiving an adjustment element 40 releasably connected to the front sight 10, and a spring element 75. The two sections 22, 23 are separated in the hollow space by a circumferential projection 24 that protrudes radially inward, which has a hole 24*c* in the middle.

Part of the adjustment element can extend from the second section into the first section through the hole 24*c*, such that the adjustment element 40 can move inside the first and second sections 22, 23 of the front sight support element 20 in the axial direction.

The circumferential projection 24 has a lower surface, which faces the axle 30 (FIG. 3) not shown here, forming an end surface 24*a* that serves as a bearing surface for the spring element 75 (FIG. 7), also not shown here. The projection 24 has an end surface 24*b* on its upper surface, i.e. facing the front sight 10, not shown here, which serves as a limit element for the front sight 10, i.e. the front sight 10 can bear on this surface 24*b* at its axial end of section 12. When the front sight 10 bears on the surface 24*b*, the front sight 10 is at its lowest position.

The front sight support element 20 also has two threaded holes 27, 29 on the lower end of the second section 23. The axle 30, not shown, can be inserted into these two holes 27, 29 to support the front sight support element 20 on the mount 50 (FIG. 5) which is not shown. A turning of the axle 30 can also be transferred to the front sight support element 20 via these threaded holes 27, 29, such that it can be moved laterally. In order to obtain a reliable and robust front sight support 20, the regions surrounding the threaded holes 27, 29 are reinforced. The end of the section facing the threaded holes 27, 29 has a circular section, i.e. with a radius r3, which makes it possible to fold it up and down without the front sight support element 20 coming in contact with the mount 50 or the gas block 60.

The front sight support element 20 also has a guide element 28 on the axial end of the second section 23 for the adjustment element 40. The guide element 28 is formed by axial slots through the second section 23. In other words, the guide element 28 separates the second section 23 into two tabs 23*a*, 23*b*, each of which has a threaded hole 27, 29, with the slots being placed symmetrically between the these two holes 27, 29.

The outer shape of the hollow body 21 clearly has an octagonal cross section and an H-profile.

There are two grooves 25, 26 on the upper end of the first section that intersect at a right angle, into which the front sight 10 is snapped. These have corners in this example, and are the same size, such that the front sight can be rotated and locked in place in 90° increments. Other shapes are also possible. In particular a so-called flattened U-profile is also conceivable, which is parallel to the gun barrel, extending in the viewing perspective of the shooter.

Figure 3:
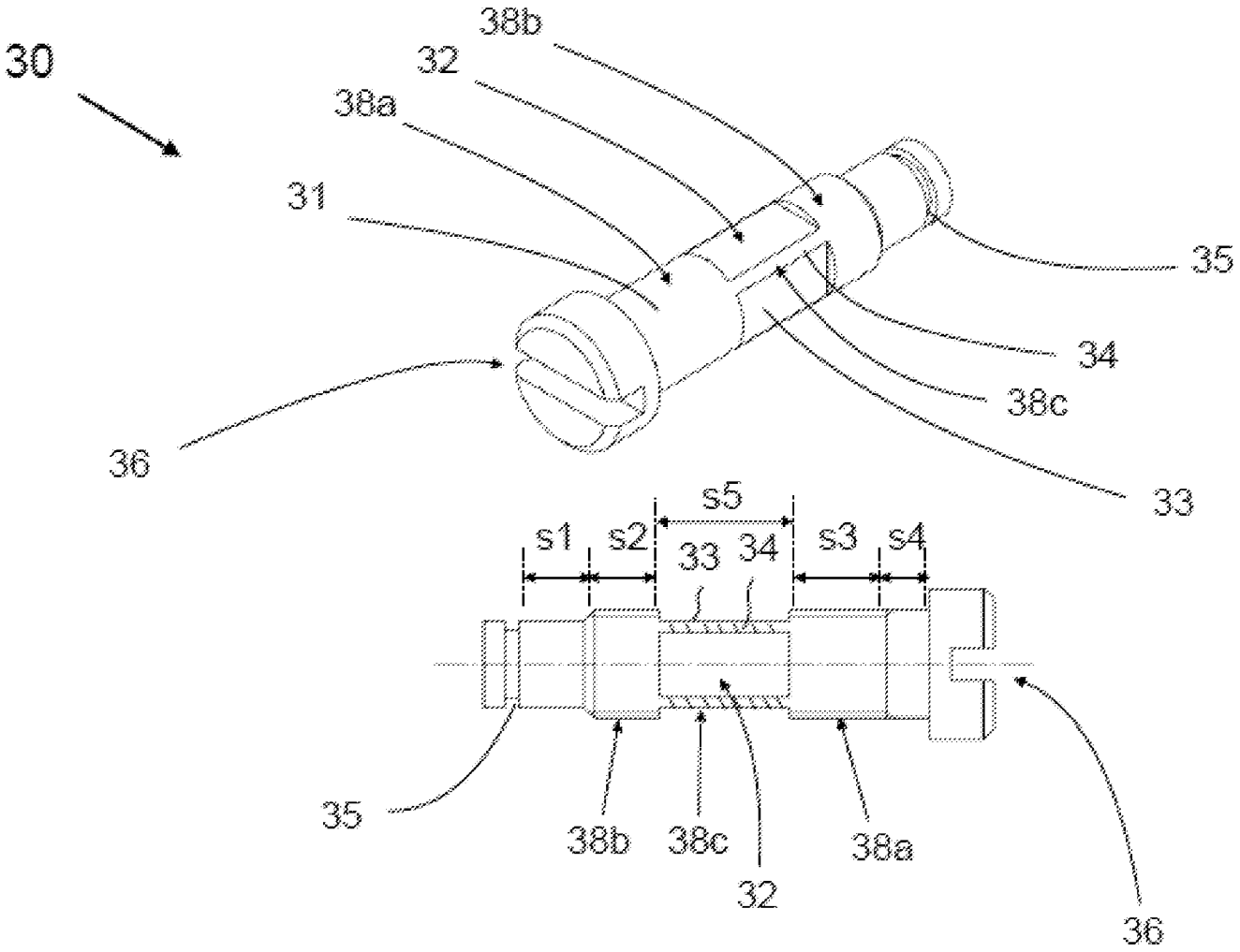
FIG. 3 shows from two perspectives an example of an axle for pivotally supporting the front sight support element in FIG. 2.
Figure 5:
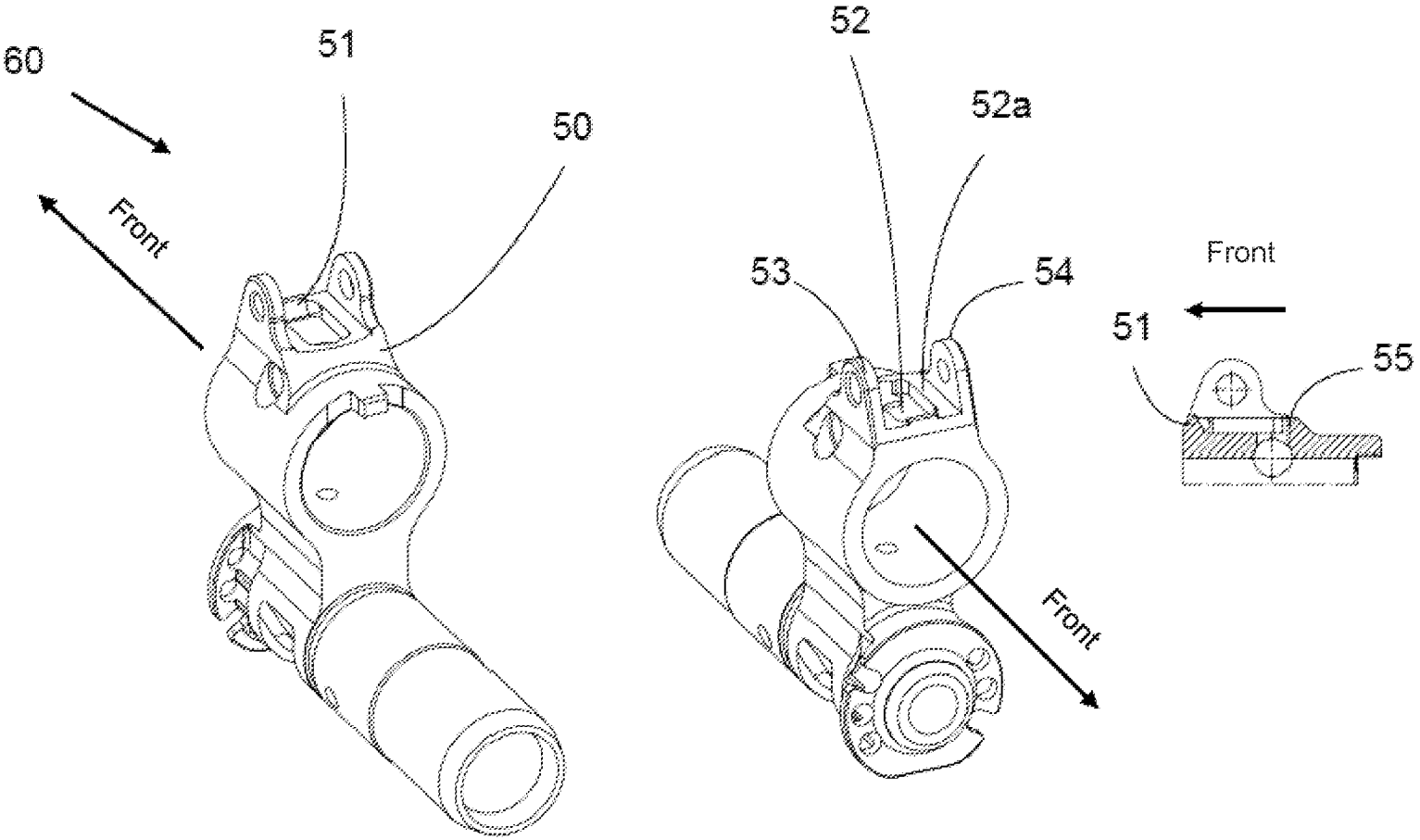
FIG. 5 shows from two perspectives and in a sectional view an example of the mount for supporting the axle in FIG. 3.

FIG. 3 shows an axle 30 in an example for an adjustable sight assembly 70, with which the front sight support element 20 in FIG. 2 can be pivotally supported on a mount 50 (FIG. 5).

The body 31 of the axle 30 has a profile 32 that corresponds to a first geometry 45, 45*a* of a hole 44 in the adjustment element 40 (FIG. 4), and via which a torque can be transferred from the axle 30 to the front sight support element 20 and vice versa. The axle body also has a first threaded section 38*a* and a second threaded section 38*b*, which can transfer the rotation of the axle to the front sight support element 20 in order to move the front sight support element laterally.

The profile is located axially between the two threaded sections 38*a*, 38*b*, such that the profile 32 borders on the threaded sections 38*a*, 38*b* on the axle body 31 in both directions. The treaded sections 38*a*, 38*b* extend axially along sections s2 and s3 respectively, as can be readily seen in the lower image.

The two threaded sections 38*a*, 38*b* are connected to one another by another threaded section, or a threading 38*c*, such that these three threaded sections 38*a*, 38*b*, 38*c* for a single continuous threading. The threading 38*c* in the lower image is indicated by diagonal lines (slanted downward from left to right). The threading 38*c* runs axially between sections s2 and s3 and on the outer surface sections 34. The threading 38*a*, 38*b*, 38*c* is a fine pitch thread, i.e. a thread with a narrow profile and shallow slope.

The profile 32 is formed by four recesses 33 on the circumference forming planar surfaces, with each planar surface at 90° to the two adjacent planar surfaces. In other words, the cross section of the profile 32 of the axle 30 forms a type of rectangular nut. The profiled section 32, i.e. the four planar surfaces 33 are not threaded, and only the sections 34 forming the outer surface sections between the respective planar surfaces 33 are threaded 38*c*.

At one of its two ends, the axle 30 has a circumferential groove 35 for a retaining ring. At its other end, the axle 30 has a slotted head 36. A tool, e.g. in the form of a screwdriver or a coin, can be placed therein for the lateral adjustment of the front sight support element 20.

Starting from the circumferential groove 35, there are the sections s1, s2, profile 32, s3, s4 and the slotted head 36 in the axial direction. Sections s1 and s4 are those sections of the axle body 21 that are placed in the holes in the mount 50. Sections s2 and s3 are threaded into the corresponding holes 27, 29 when the front sight support element is in the middle.

If the front sight support element 20 is moved to the left or right from the middle, the threaded section 38*c* can also be threaded into the holes 27, or 29.

It can be readily seen that the diameter of the one section s1 is smaller than the diameter of the other section s4. Because the holes in the mount correspond to these diameters, they are also of different sizes. Consequently, the axle 30 can only be inserted in the mount from one side, which is on the right in this case. The diameters of sections s2, s3 and s4 are substantially the same. It can also be clearly seen that the flattened recesses 33 are located axially between s2 and s3.

Figure 4:
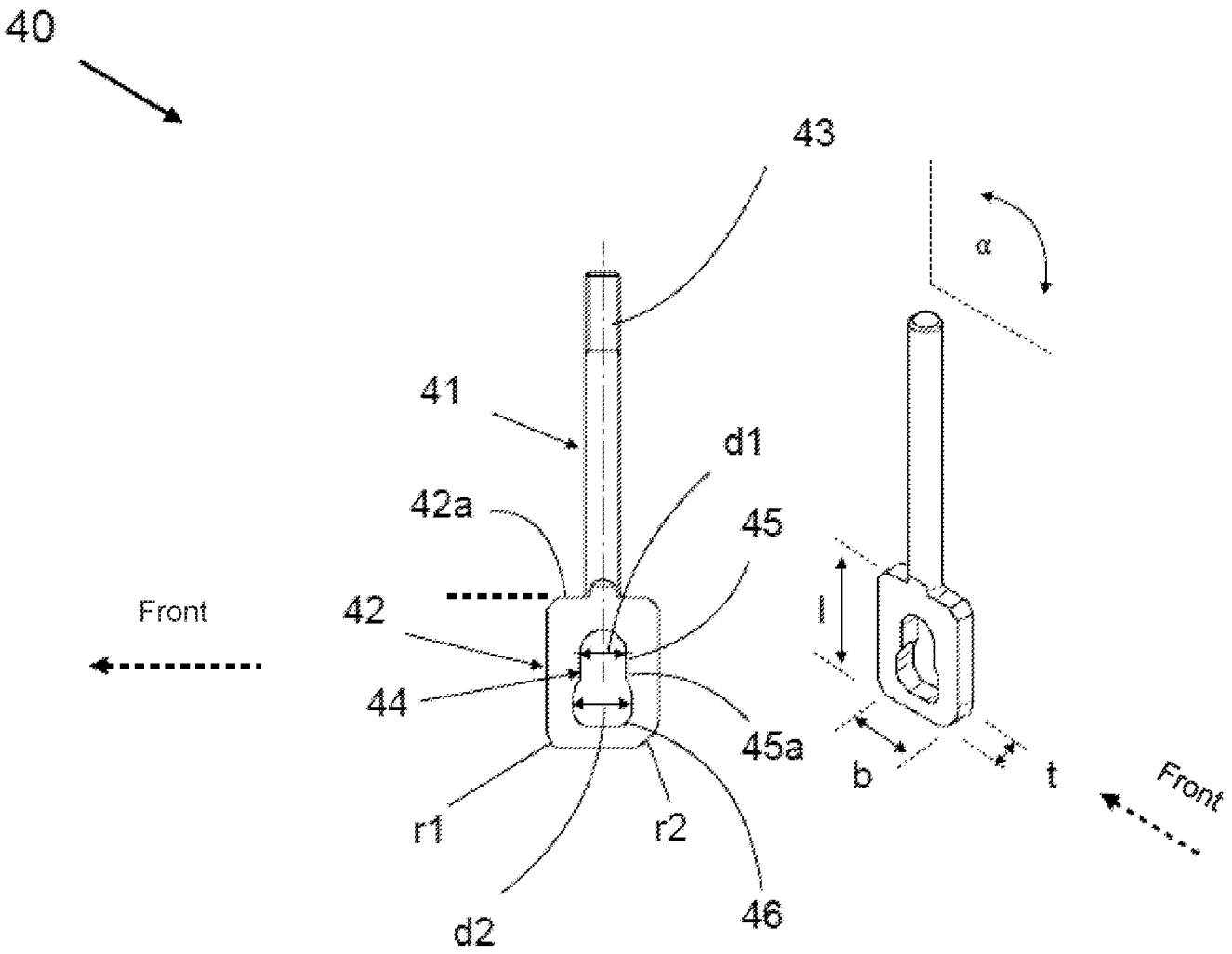
FIG. 4 shows from two perspectives an example of an adjustment element.

FIG. 4 shows an adjustment element 40 in an example for an adjustable sight assembly. The adjustment element 40 is shown in the upright position, and can be pivoted about an angle α, thus folding it down. The angle through which it is pivoted from the upright position to the horizontal position is 90°.

The adjustment element has a first section 41 that extends longitudinally, and a planar second section 42 connected to the first section. The first section is cylindrical and has a threading 43 on its end with which it can be releasably connected to the front sight 10 shown in FIG. 1. The cylindrical section (including the threaded section 43) is approximately eight times as long as its diameter.

The second section is flat and planar and is substantially rectangular in shape with a length 1, width b and thickness or depth t. The width is approximately four times the thickness t. The length 1 is approximately 1.5 times the width b. The first section 41 is approximately twice the length of the second section 42. The second section 42 also has rounded or flattened corners r1, r2, which shall be explained below in greater detail.

One of the two short sides of the second section 42 is connected in the middle to the end of the cylindrical first section 41 opposite the end with the threading 43. This is the upper side of the rectangle, or second section 42. The thickness t of the second section 42 corresponds approximately to the diameter of the cylindrical section. The second section 42 also has a bearing surface 42*a* on its upper surface, on which a spring element 75 that is coaxial to the first section 41 is braced, or on which the spring element 75 can be brought to bear.

The adjustment element therefore schematically resembles the shape of a key blank.

The second section 42 has a keyhole type opening 44 according to the disclosure, through which the axle in FIG. 3 can be inserted to support the front sight support 20 in FIG. 2.

The keyhole opening 44 passes through the second section and is substantially formed by two geometric shapes, specifically a circular section 45 with a straight section 45*a* and a rectangular section 46 with rounded corners. The circular section 45 with a diameter of d1 is above the rectangular section 46, which has a diameter d2 that is greater than the diameter d1.

It is advantageous when the circular section 45 transitions into the straight section 45*a* with the same diameter d1, which then transitions into the rectangular section 46 after a defined length. The straight section 45*a* that connects the two shapes is at least in part parallel to the rotational axis of the cylindrical body of the first section 41. The straight section 45*a* functions like a square wrench in the torque-transferring position, which encompasses a square nut. The straight section 45*a* is part of the first shape, in particular.

The hole 44 is forms a torque-transferring connection with the axle 30 in the circular section 45, which is released when the axle is slid down into the rectangular section 46, such that the front sight support element 20 can be moved laterally. To obtain the respective positions, or connections, the adjustment element 40 can be moved at a right angle to the axle 30. As a result, the circular section 45, 45*a* or the rectangular section 45 can be brought into either an engaged position or released position, respectively, with the profile 32 of the axle 30. To obtain a structurally simple solution, the diameter d1 is selected such that it is slightly smaller than the diameter of the axle body 31, such that the straight section 45*a* fits snuggly onto the planar profiles 32, 33 of the axle.

The adjustment element 40 has rounded corners at its lower end, which have a first radius r1 and a different second radius r2. When upright, the side with the smaller radius r1 is closer to the muzzle, thus facing forward, and the larger radius r2 faces toward the back. When folded down, the side with the smaller radius r1 then faces upward, and the side with the larger radius r2 faces downward and is in contact with the mount 50. This geometry has proven to be particularly advantageous in terms of the interaction with the mount 50, as shall be explained in greater detail below.

FIG. 5 shows a mount 50 in an example for the front sight support element shown in FIG. 2 with an integrated adjustment element shown in FIG. 4. The mount 50 is attached to a gas block 60. The mount has a base 52 or floor with a frame 52*a*. The frame 52*a* forms a recess with the base 52, into which part of the adjustment element 40 extends during the pivot movement.

There are two opposing tabs 53, 54 on the frame that are substantially perpendicular to the surface of the base 52, which receive the axle 30 for a pivotal support of the front sight support element 20.

The adjustment element 40 comes in contact with the base 52 and a guide element 51 on the base 52 or frame 52*a* while it is being flipped up and down. Because the adjustment element 40 is spring-loaded, it can pass over the base 52 and the guide element 51 against the force of the spring element 75. When in the upright position, the adjustment element 40 is pressed against the base 52 by the spring element 75.

The adjustment element 40 is snapped in place by the guide element 51, or the contact surface in both the upright position and when it is folded down. The contact surface 51 is at an angle to the base 52 and parallel to the axle 30, and is shaped like a ramp, the sloped side of which faces the adjustment element 40. An angle of ca. 60° to 75° has proven to be particularly advantageous for the ramp, in that this results in a secure snapping in place.

The mount 50 also has a dead stop 55, against which the front sight support element 20 is braced when it is folded down.

Figure 6:
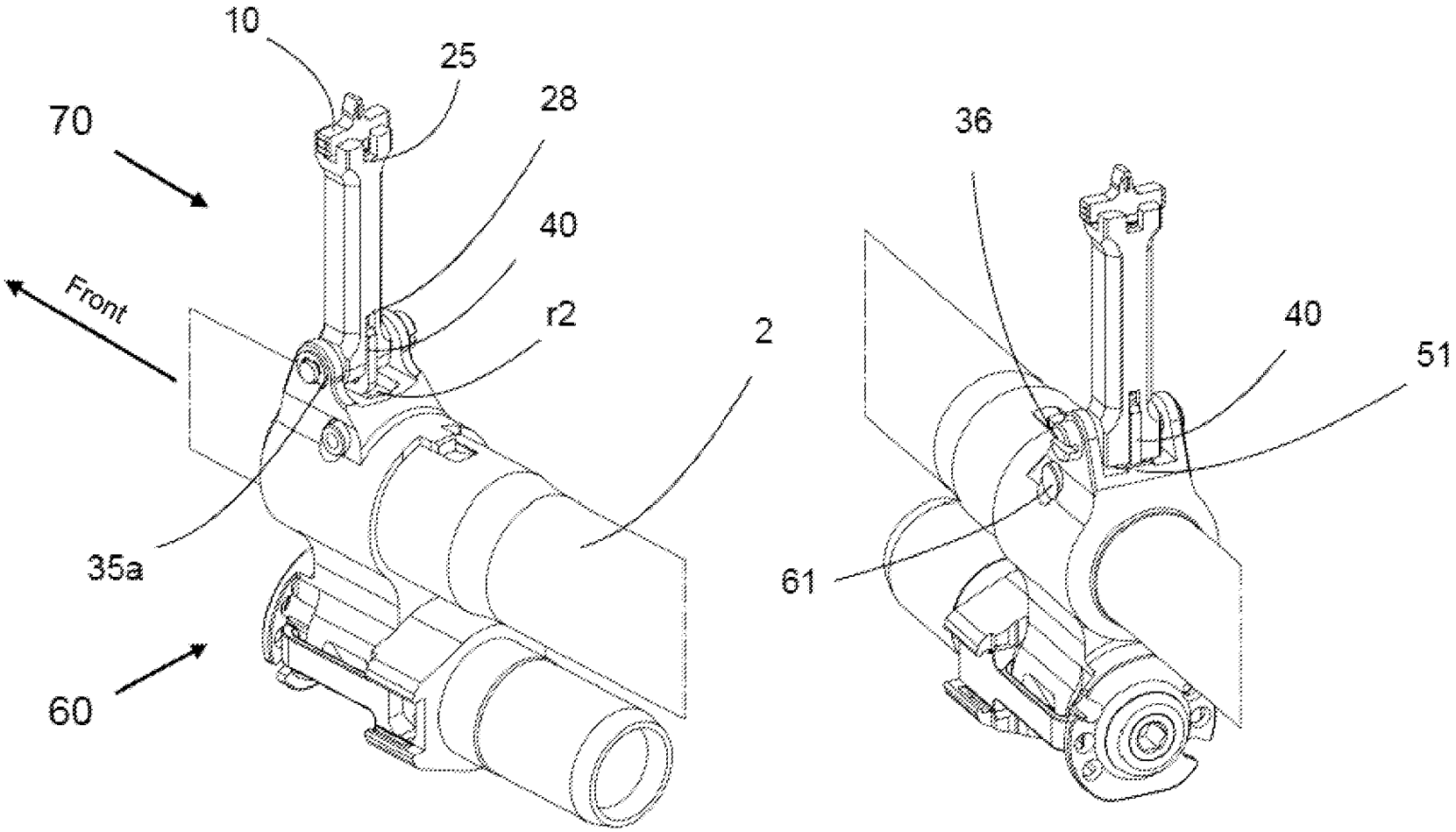
FIG. 6 shows from two perspectives an example of a sight assembly.

FIG. 6 shows an adjustable sight assembly 70 in accordance with an example, forming a flip up sight assembly that can be adjusted vertically and laterally, which comprises a front sight support element 20 that is pivotally supported by an axle 30 on a mount 50, in which the front sight support element 20 has an adjustment element 40 supported on a spring element (not shown) that is releasably connected to the front sight 10, which has a keyhole opening (not shown) through which the axle 30 is inserted. The adjustment element 20 can be moved with and against the spring force between two positions in relation to the axle 30 in the front sight support element 20, such that the keyhole opening prevents a lateral movement of the front sight support element 20 along the axle 30 when it is engaged with the axle, and allows the lateral adjustment of the front sight support element 20 when it is in the released position.

The sight assembly 70 comprises the adjustment element 40 from FIG. 4, the which is supported inside the front sight support element 20 shown in FIG. 2, and releasably connected to the front sight in FIG. 1. The sight assembly 70 also comprises the mount 50 shown in FIG. 5, on which the front sight support element 20 and the adjustment element 40 are pivotally supported by the axle 30 shown in FIG. 3. The axle 30 is axially secured in place on the mount 50 by a retaining ring 35*a*. The mount 50 is part of the gas block 60. The gas block 60 is secured on the gun barrel 80 by a rivet 61.

It can also be clearly seen how the second section 42 of the adjustment element 40 is guided in the slots 28 on the front sight support element 20. The lower surface of the second section 42 of the adjustment element 40 is braced against the base 52, i.e. the base 52 acts against the spring force pushing down on the adjustment element 40.

Figure 7:
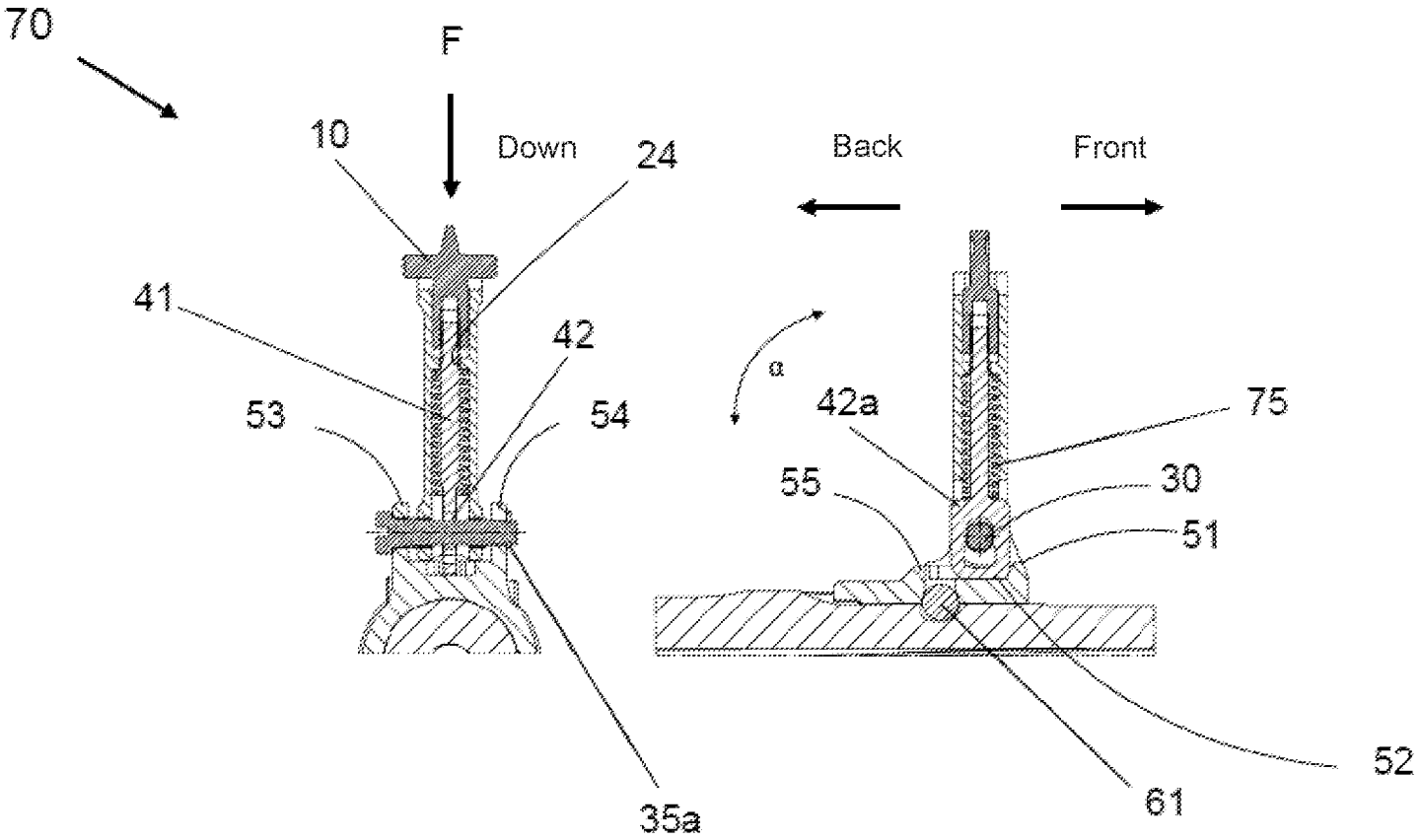
FIG. 7 shows in two sectional views the sight assembly in FIG. 6.

FIG. 7 shows the sight assembly 70 in FIG. 6 in two sectional views, when it is in the upright or flipped-up position. The front sight 10 or front sight support 20 can be pivoted to the back on a pivot axle forming a pivotal axis, i.e. it can be folded down.

FIG. 7 also shows how a spring element 75 in the form of a compression spring is braced against the bearing surfaces 24*a*, 42*a* on the front sight support element 20 and the adjustment element 40, respectively. Because the front sight support element 20 is supported on the axle 30, a force F is constantly exerted against the second section 42, which keeps the front sight 10 in its snapped-in or locked-in position. The sight assembly 70 is shown in the upright position, and the force F acts in a downward direction and presses the first geometry 45, 45*a* of the opening 44 onto the profile 32 on the axle 30.

Figure 8:
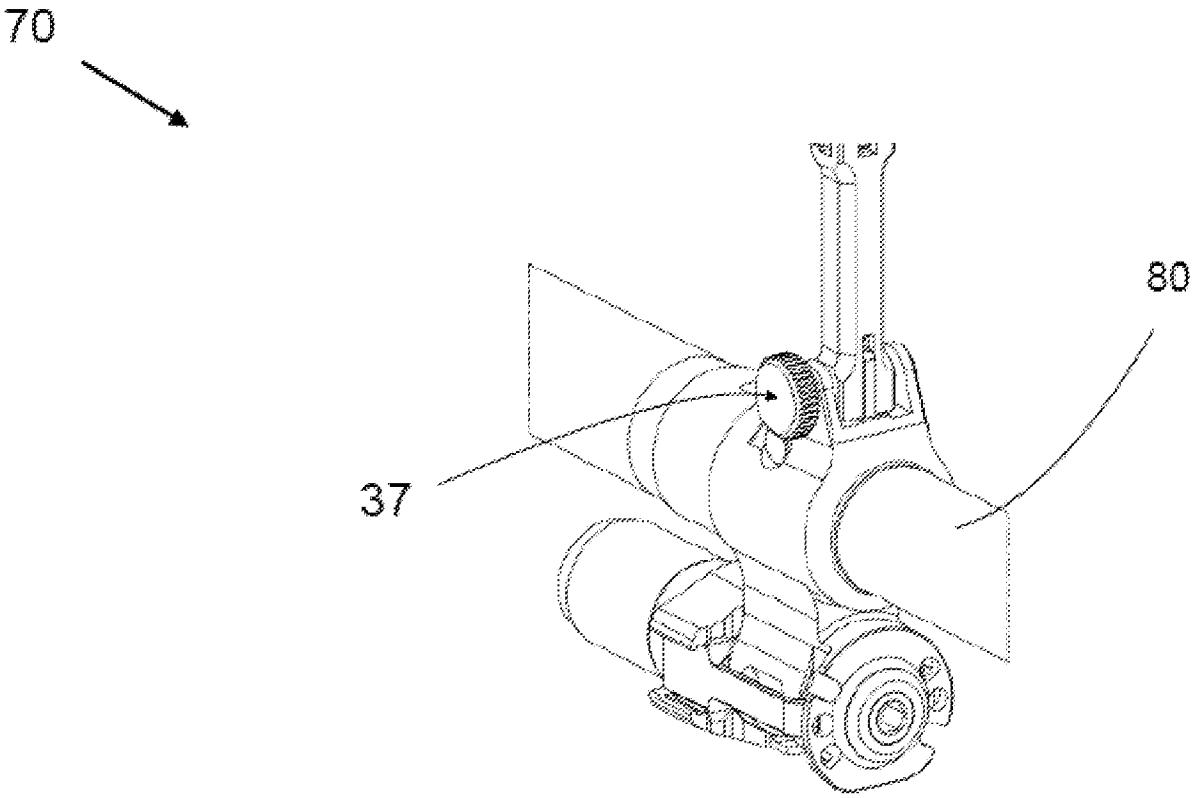
FIG. 8 shows a second example of the axle in FIG. 3.

FIG. 8 shows the sight assembly 70 with another axle 30, which has a knurled knob 37 instead of the slotted head, allowing for lateral adjustment of the front sight support element 20 without tools. The rest of the assembly is the same as that shown in FIGS. 6 and 7.

Figure 9:
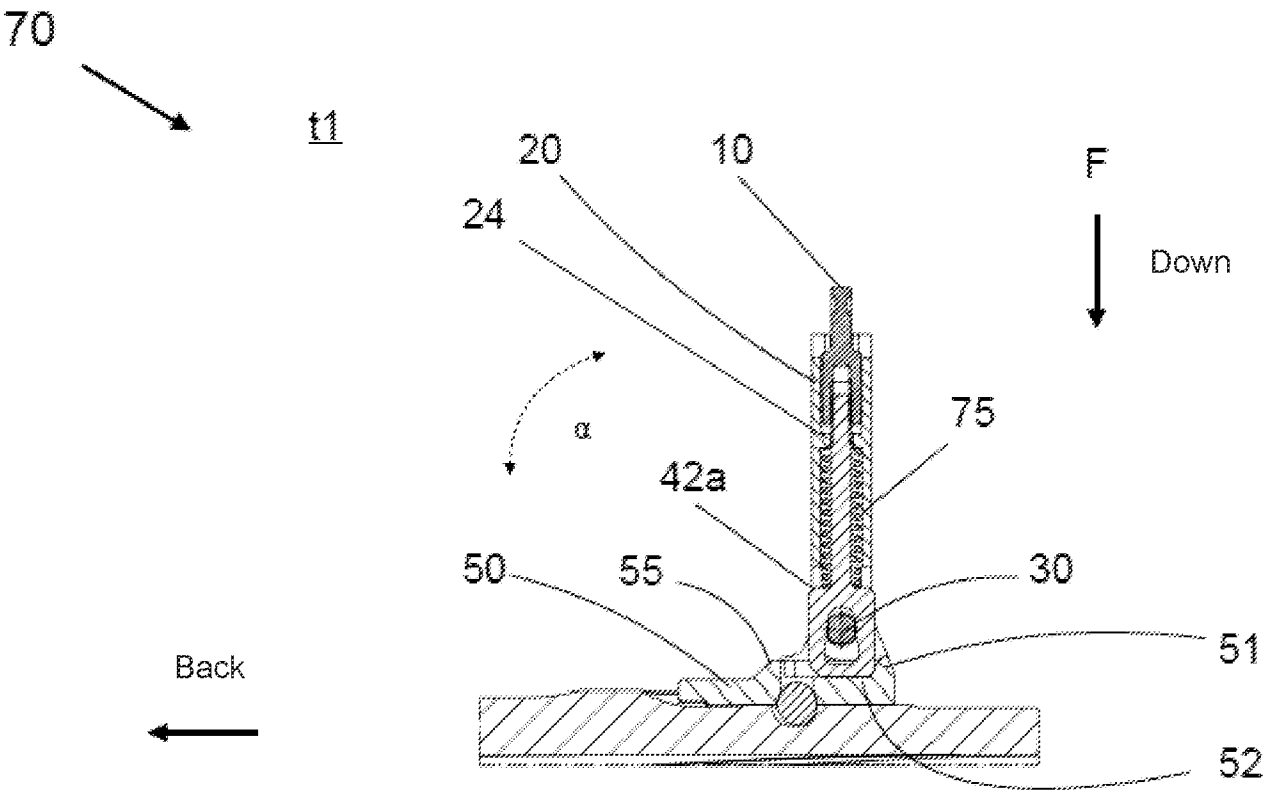
FIG. 9 shows an image t1 of a sectional view of the sight assembly in FIGS. 6 and 7 in the upright position.

FIGS. 9 to 12 show the pivoting sequence from the upright position to where it is folded down. FIG. 9 shows the starting point of the folding down sequence at time t1. The compression spring 75 presses down on the adjustment element 40. The adjustment element 40 is braced against the horizontal surface of the base 52 in the mount 50. At the small corner radius r1 on the right side, the adjustment element 40 is braced against the sloped contact surface 51 on mount 50. This prevents the front sight support element 20 from folding down while firing the weapon, and also compensates for any play, thus preventing a shaking of the front sight support element 20, and the front sight 10 in particular. The path the front sight support element 20 follows when pivoted to the back is limited by a dead stop 55.

Figure 10:
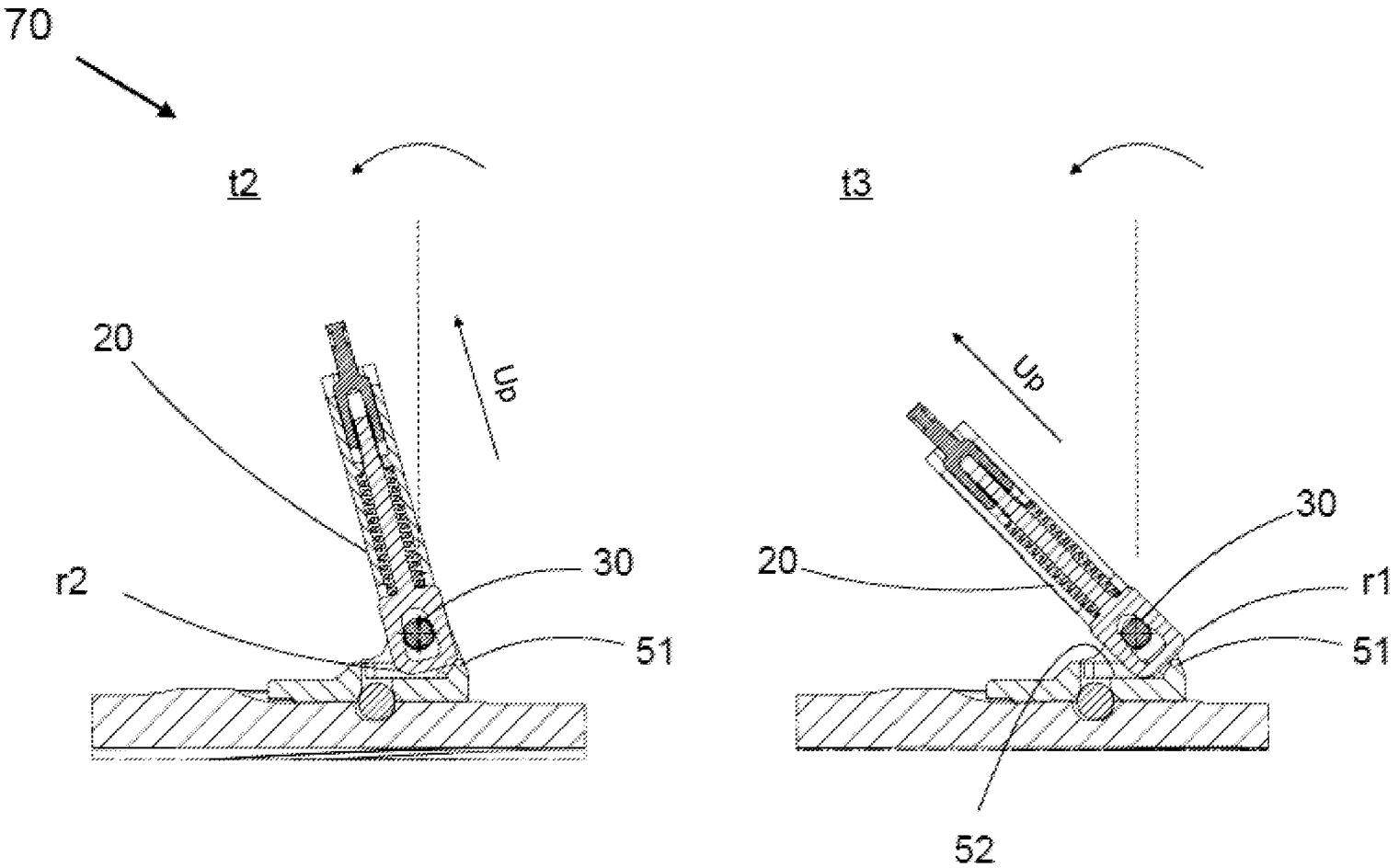
FIG. 10 shows two images (t2, t3) of a sectional view of the sight assembly in FIG. 9 while being flipped down.

FIG. 10 shows two images at time t2 and the subsequent time t3. At time t2, the small radius r1 slides over the sloped contact surface 51 on the mount 50 as the adjustment element 40 is folded down. The adjustment element 40 is consequently pushed upward against the spring force F (as indicated by the straight arrow).

At time t3, the front sight support element 20 is folded down further. The larger radius r2 on the left side of the adjustment element 40 comes in contact with the base 52 on the mount 50, while the smaller radius r1 is no longer in contact with the ramp 51. The adjustment element 40 is again lifted slightly against the spring force. As a result of the keyhole shape of the hole 44, the axle 30 is rotated via the profile 32 formed on the axle 30 for lateral adjustment of the front sight 10. Because the axle 30 is also rotated when the front sight is folded down and flipped up, it is ensured that the lateral position thereof is not altered.

Figure 11:
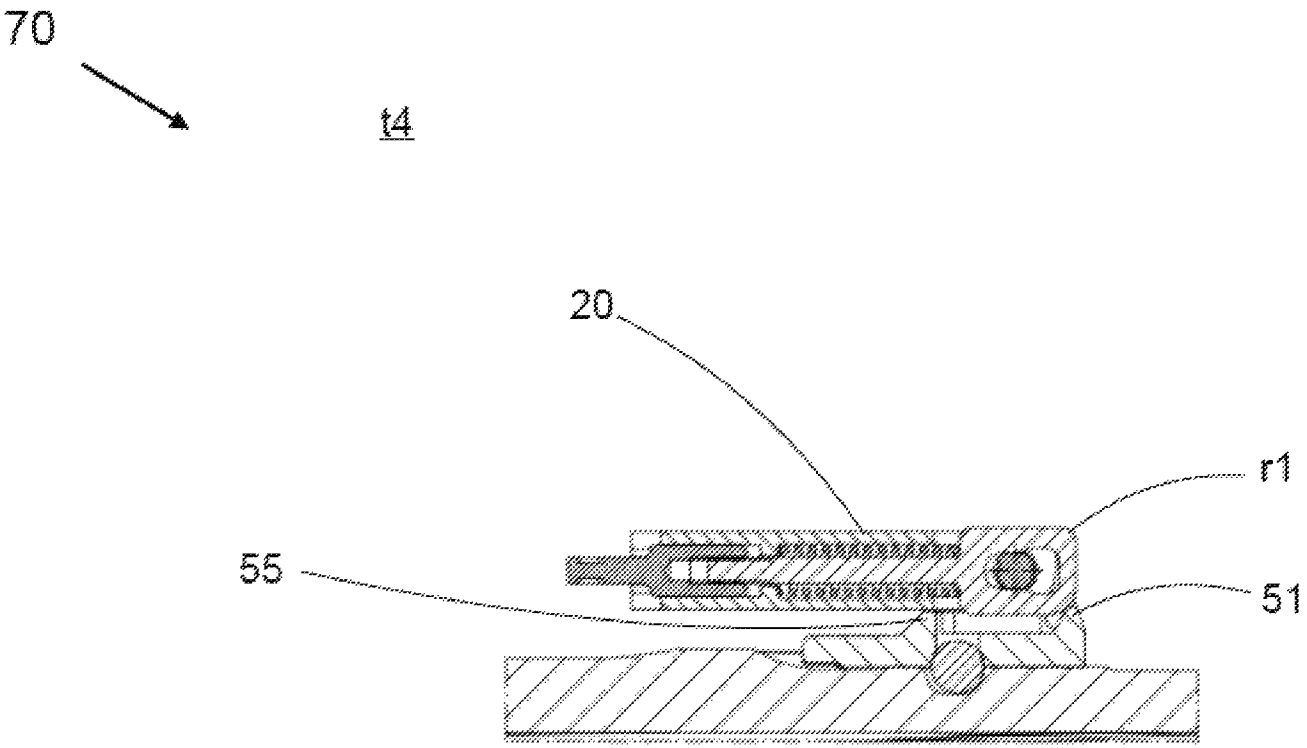
FIG. 11 shows a fourth image (t4) of a sectional view of the sight assembly in FIG. 9 when it is folded down.

FIG. 11 shows the sight assembly 70 when it is folded down, at a fourth time t4. When folded down, the front sight support element 20 is braced horizontally against the gas block 60 connected to the mount 50 via the dead stop 55. To lock it in place, the large radius r2 on the adjustment element 40 snaps in place over the ramp 51 on the mount 50.

The sight 70, or the front sight support element 20, can be flipped up and down without having to pull on the front sight 10. The radius R2 and the ramp 51 function collectively as a latching mechanism when folded down, such that the front sight support element 20 remains in this position (folded down) while the weapon is being fired. By exerting a little force, the front sight support element 20 can be released from this snapped-in position without additional pulling on the front sight, and flipped up. The front sight is flipped up into the upright position by reversing the sequence.

The second section 42 of the adjustment element 40 can therefore be brought at least in part in contact with the guide element 51 on the mount 50 when the front sight support element 20 is being flipped up or down, such that the adjustment element 40 can be moved against the force of the spring element 75. When it comes in contact with the guide element 51, the adjustment element 40 can only be moved against the force of the spring element 75 to the extent that the torque-transferring connection between the axle 30 and the front sight support element 20 is maintained during the pivotal movement.

According to the example shown in FIGS. 9 to 11, the adjustment element 40 comes in contact with the base 52 when it is in the upright position (FIG. 1). The latching function is substantially assumed by the ramp 51.

It is also conceivable to make the base 52 a little deeper, such that the adjustment element 40 does not come in contact with the base 52 when in the upright position. In this case, the ramp 51 limits the downward movement of the adjustment element 40.

Figure 12:
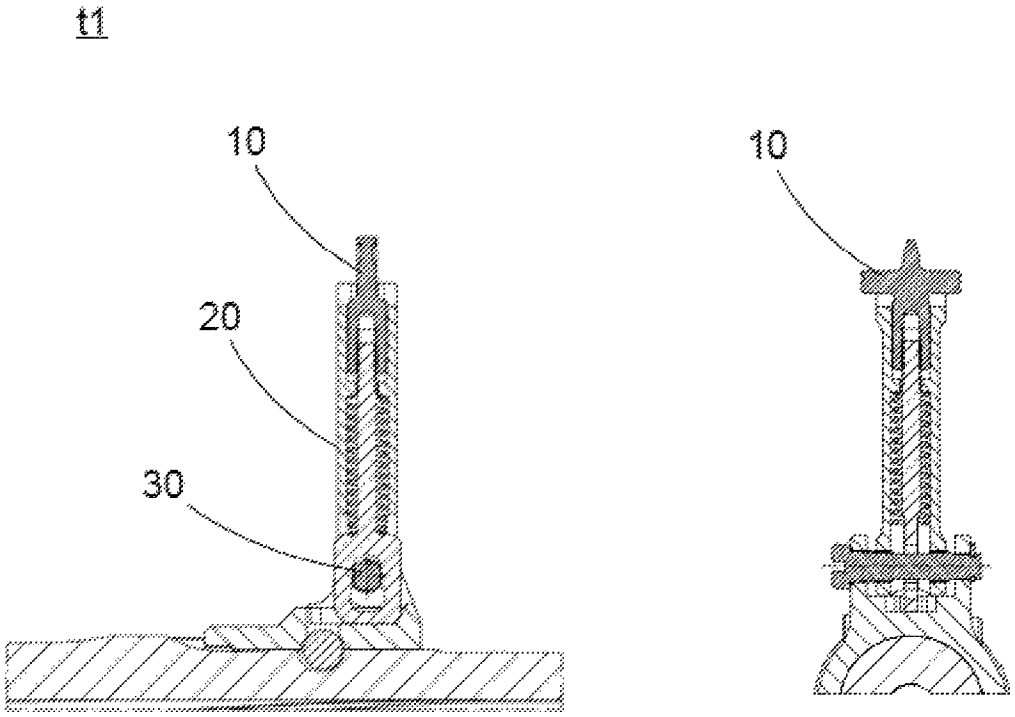
FIG. 12 shows two sectional views of the sight assembly in FIGS. 6 and 7 in the upright position shown in the first image (t1) at the start of the lateral adjustment.
Figure 13:
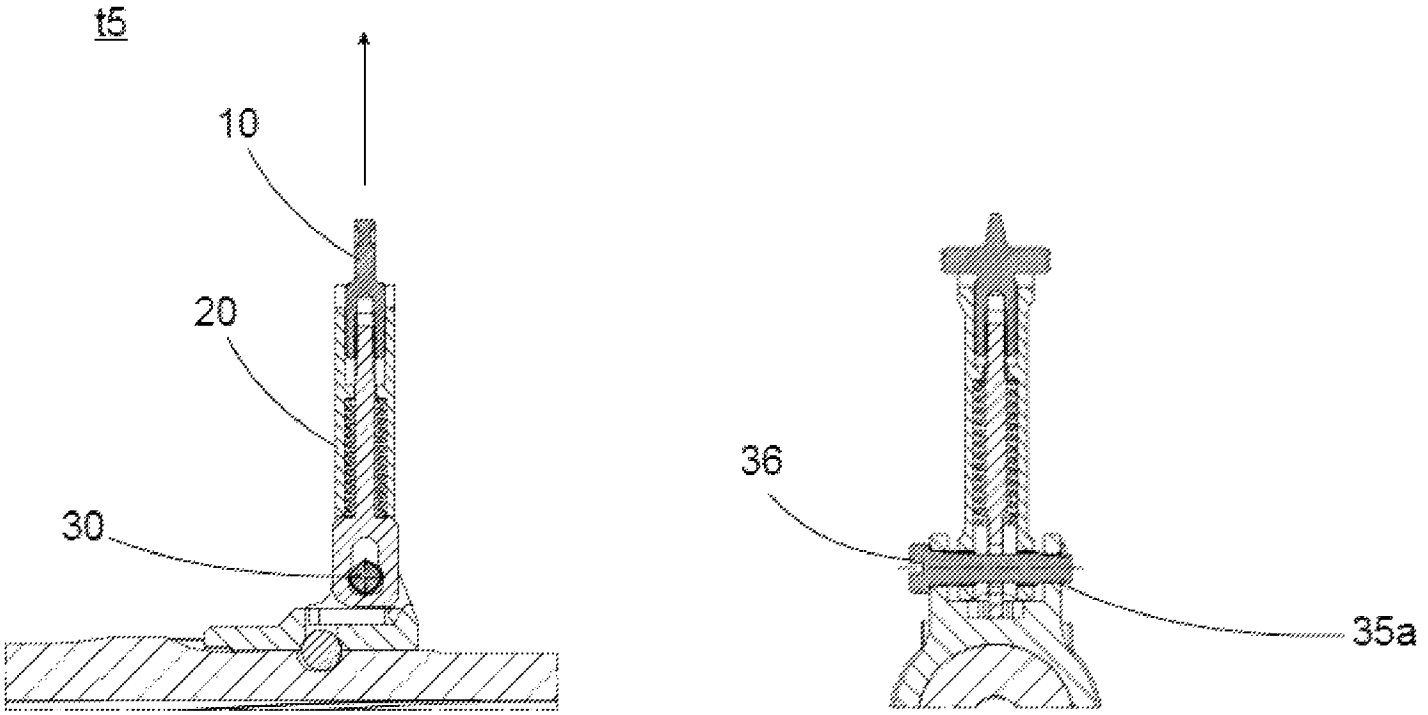
FIG. 13 shows two sectional views of a fifth image (t5) of the sight assembly in FIG. 12 with the front sight pulled out.
Figure 14:
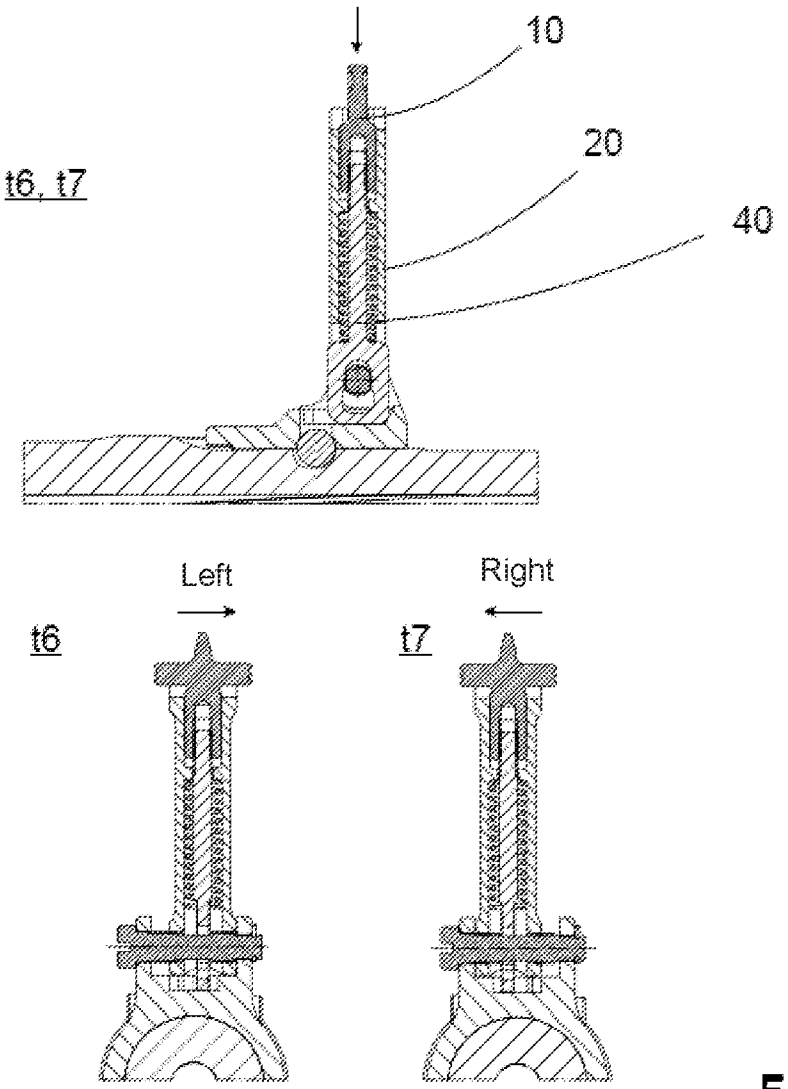
FIG. 14 shows three sectional views of sixth and seventh images (t6, t7) of the sight assembly in FIG. 12 after completion of the lateral adjustment.

FIGS. 12 to 14 show the process for the lateral adjustment of the front sight support element 20, or the front sight 10. FIG. 12 shows the example of the sight assembly 70 shown in FIG. 9: the front sight 10 is shown in the middle position, when it is upright.

For lateral adjustment, the front sight 10 is pulled up with the adjustment element 40 against the spring force at time t5, as shown in FIG. 13. In the upper position, the rectangular section 46, i.e. the "square wrench" of the keyhole opening 44, releases the profile 32, i.e. the square nut of the axle 30, such that it can be moved laterally. The axle 30 then be rotated (using a tool). The axle 30 is axially secured by a retaining ring 35*a* in the mount 50, and therefore secured in place on the gas block 60. The rotation of the axle 30 is transferred to the front sight support element 20 via the threaded coupling of the pairs of threads 27, 29 and 38*a*, 38*b*, thus pushing it axially, or moving it laterally.

Once the desired position has been reached through the lateral movement of the front sight support element 20, as shown in FIG. 14, the front sight 10 can be released. The front sight 10 is pushed downward with the adjustment element 40 by the spring force. The profile 32 (square nut) on the axle 30 is then brought into engagement with the first geometry 45, 45*a* (square wrench) in the keyhole opening 44 on the adjustment element 40, and thus locked in place.

FIG. 14 shows the end position of the lateral movement toward the left at time t6, and the end position of the lateral movement toward the right is shown at time t7. When the front sight 10 is pulled out of the latching position, the opening 44 in the adjustment element 40 is moved in relation to the axle 30 such that the adjustment element 40 is released from the torque-transferring connection with the axle 30, such that the front sight support element 20 can then be moved laterally. Furthermore, when the torque-transferring connection is released, the lateral movement of the front sight support element 20 is obtained by turning the axle 30 that is axially secured on the mount 50, and the rotational movement of the axle 30 is transferred to the front sight support element 20 via the threaded coupling 27, 29 and 38*a*, 38*b* between the axle 30 and the front sight support element 20, such that it is moved laterally.

Figure 15:
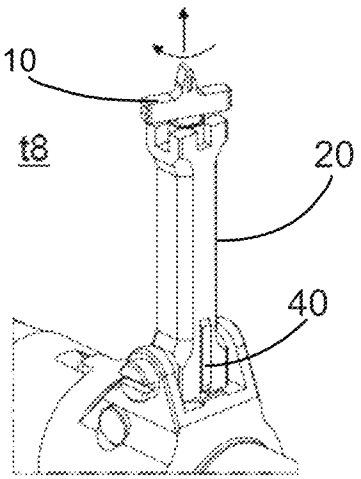
FIG. 15 shows the sight assembly in FIG. 9 in the first image (t1) at the start of a vertical adjustment and in an eighth image (t8) with the front sight pulled out of the snapped-in position and rotated, from two perspectives and in two sectional views.
Figure 15:
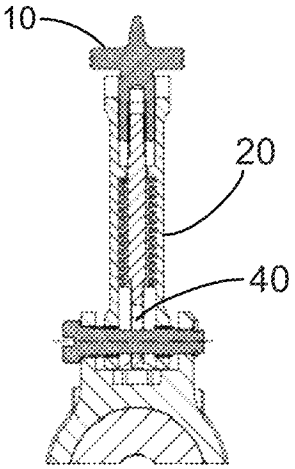
Figure 15:
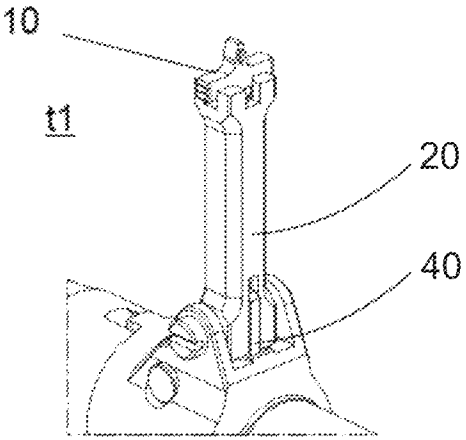
Figure 15:
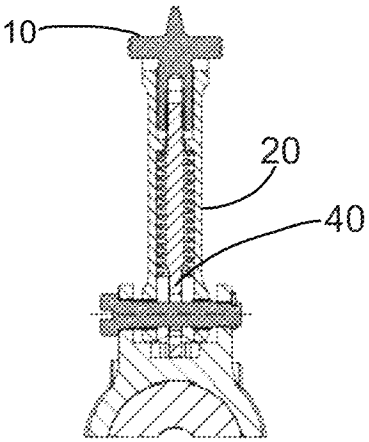
Figure 16:
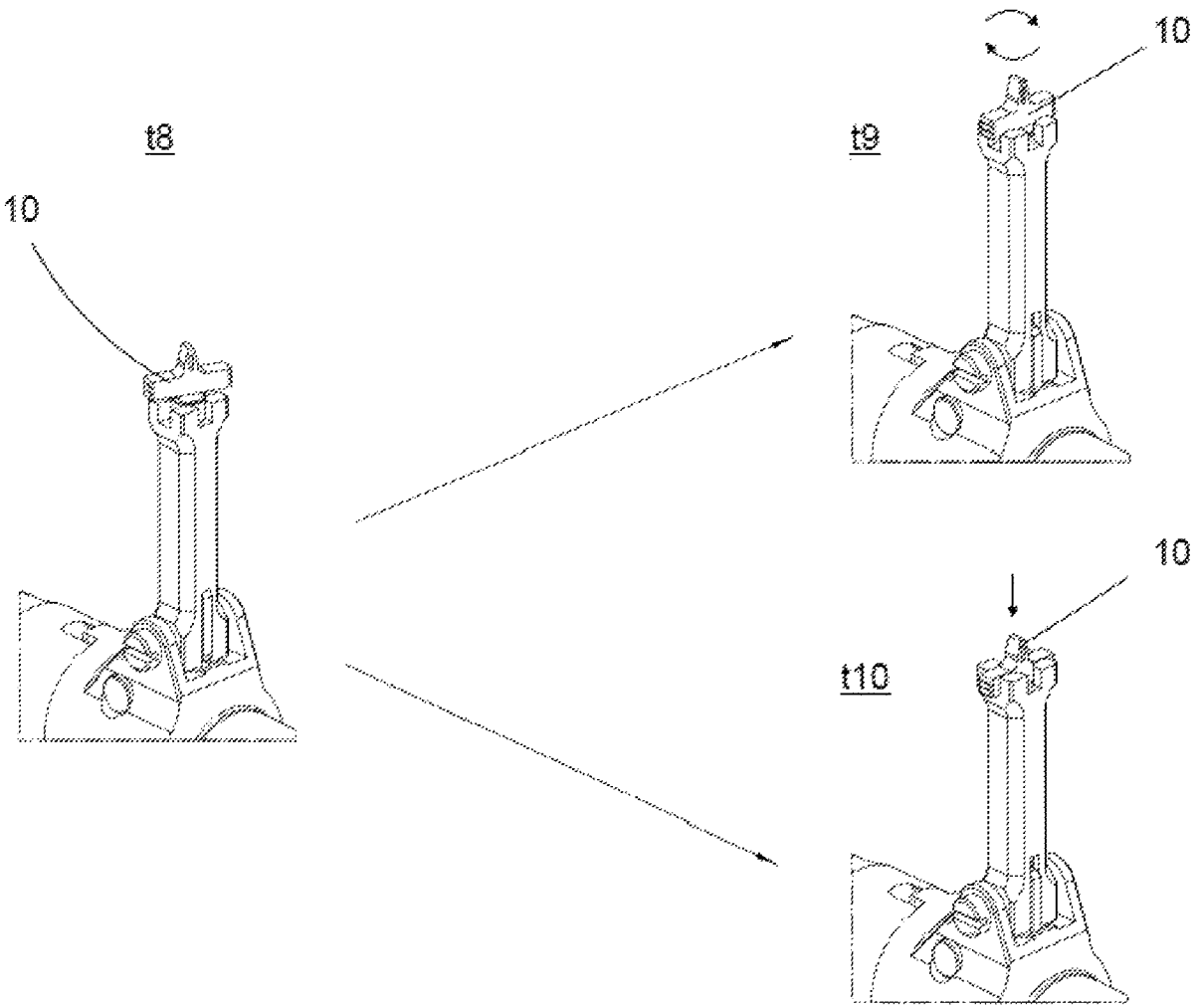
FIG. 16 shows from three perspectives the sight assembly in FIG. 15 in the eighth image (t8) and in ninth and tenth images (t9, t10) after completion of the vertical adjustment.

FIGS. 15 and 16 show the vertical adjustment process for the sight assembly 70. In the starting position at time t1, the front sight 10 is locked in place by the groove in the front sight support element 20. To adjust the height, the front sight 10 must be pulled upward with the adjustment element 40 against the force of the compression spring 75. In this upper position, the front sight 10 can then be turned, as shown at time t8. The height of the front sight is adjusted by the manual turning of the front sight about its own axis via the threads 12, 43 between the front sight 10 and the adjustment element 40. When the front sight 10 is then released at time t9, it is snapped back in place in the groove in the front sight support element 20, as shown in FIG. 16 at time t10. Times t9 and t10 show the front sight 10 in the upper and lower end positions.

The front sight 10 can therefore be pulled against the spring force from where it is snapped in place, in which a turning of the front sight 10 is prevented, to a position where it can be turned, such that the height of the front sight 10 can be adjusted.

Figure 17:
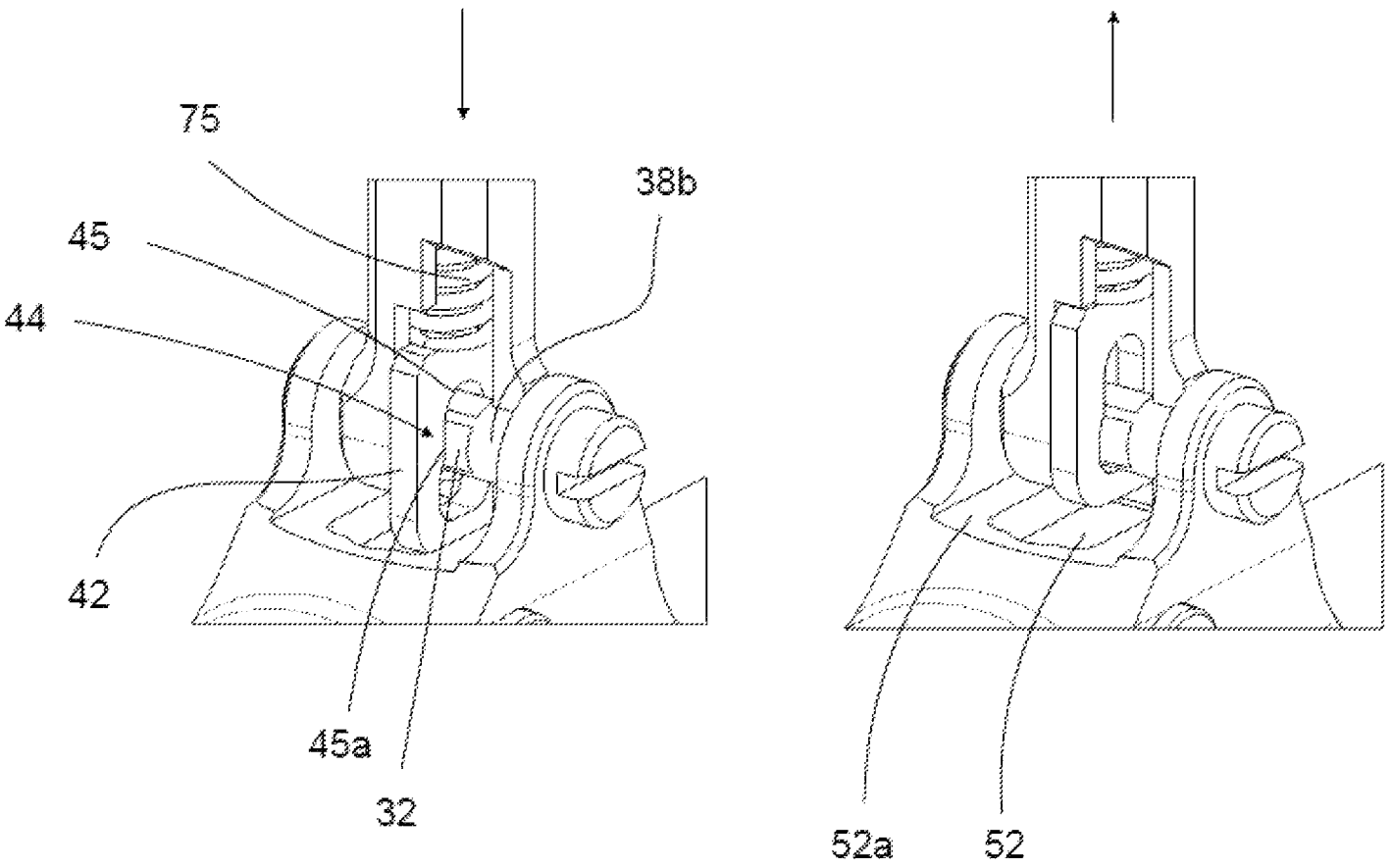
FIG. 17 shows from a perspective and with a cutaway a portion of the sight assembly, in particular showing the engagement of the axle and adjustment element.

FIG. 17 shows another illustration of the functioning of the keyhole opening 44 with the profile 32 on the axle 30 from a perspective, with a portion of the sight assembly 70 cut away to expose the interior.

The upright position is shown on the left, in the position shown in FIGS. 9, 12 and 14. The compression spring 75 pushes the adjustment element 40 downward such that the geometry 45, 45*a* is brought into engagement with the profile 32 on the axle 30. The second section 42 is also pushed into the base 52 on the mount 50. It can be clearly seen how the straight section 45*a* is parallel to the planar sections 32 and lies flush against them, in the manner of a square wrench on a square nut.

It is shown in the position when it has been pulled up on the right side of the figure, corresponding to the position shown in FIGS. 13 and 15. The front sight 10 pulls the adjustment element 40 up, against the force of the spring 75, such that the axle 30 is encompassed in the second geometry. The second geometry 45 has a greater diameter and allows the axle 30 to turn about its own axis.

Figure 18:
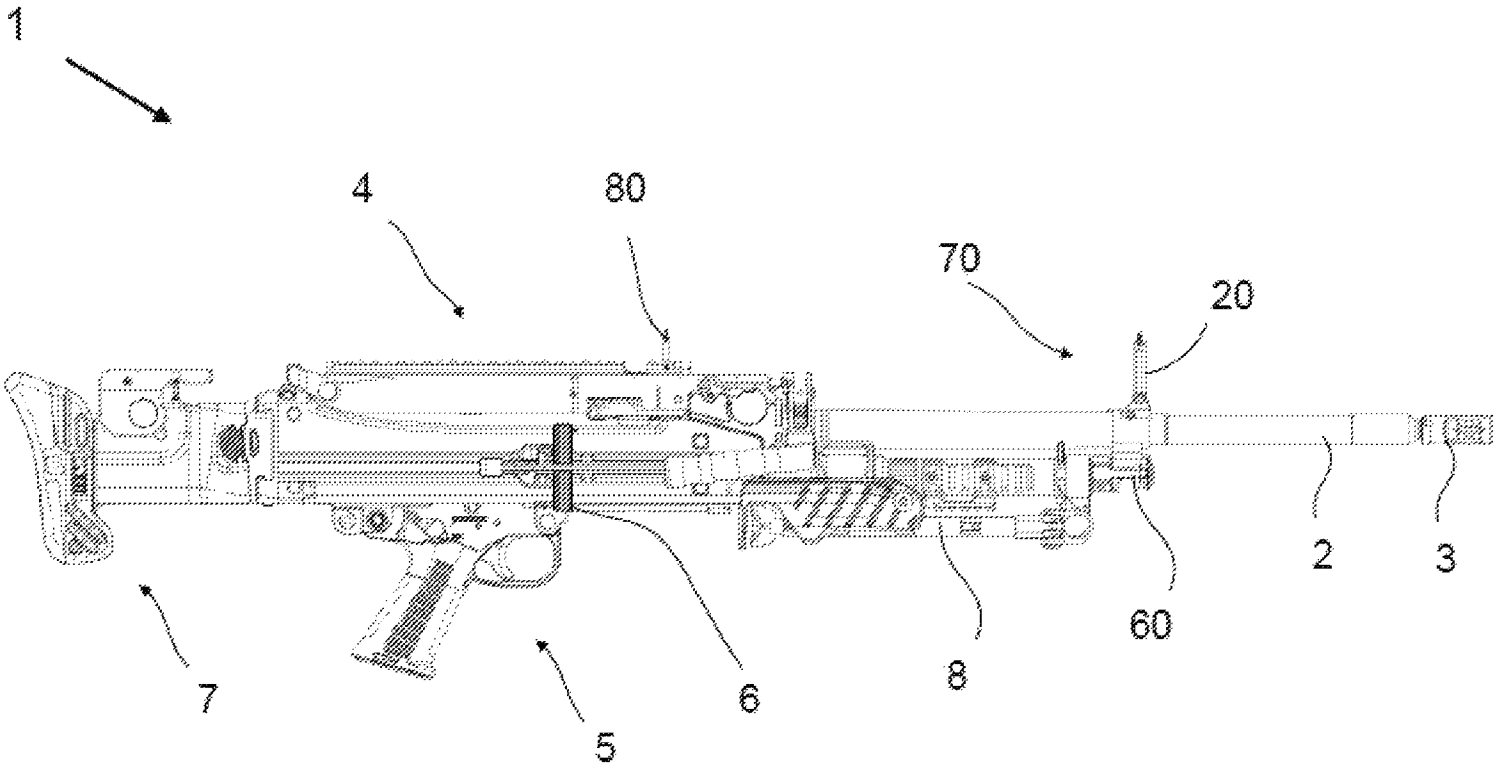
FIG. 18 shows a side view of an automatic firearm with the example sight assembly.

FIG. 18 shows a side view of an automatic firearm 1 with the sight assembly 70 described above. The automatic firearm 1 contains a rear sight assembly with a rear sight 80 that is complementary to the sight assembly. The sight assembly 70 and the rear sight assembly 80 are shown in their upright positions.

The automatic firearm 1 in the present example is an automatic weapon in the form of a machine gun (MG5). The MG5 is a, gas-operated belt-fed 7.62×51 mm caliber machine gun. The MG5 substantially comprises the following components and elements: the gun barrel 2 with the gas block 60 and a flash suppressor 3 mounted thereon; a receiver 4 in which the gun barrel 2 is placed; and a handle 5 mounted on the receiver 4. There is also a gas-operated loader 6 and a breechblock assembly in the receiver. The weapon 1 also has a shoulder rest 7. The MG5 also comprises mounting rails for scopes, optronics and accessories, and a bipod 8 mounted on the gas block 60.

The individual components and elements and their functioning—with the exception of the sight assembly 70 according to the disclosure—are known per se. There is no need to explain further equipment features of the machine gun MG5 in the framework of this disclosure, as they are not relevant to the disclosure. The disclosure is not limited to a specific type of firearm, and instead can be used with numerous different firearms. In particular, existing firearms, specifically machine guns and assault rifles, can be retrofitted with the sight assembly described above. The sight assembly according to the disclosure can be combined in particular with known rear sights.

Further designs consistent with the disclosure can be derived by the person skilled in the art in the framework of the following aspects, claims, and attached drawings.

Example aspects of the sight assembly shall be described below:

Aspect 1: An adjustable sight assembly for an automatic firearm, comprising a front sight support element that is supported on a mount with an axle, wherein the front sight support element has an adjustment element that is supported on a spring element and releasably connected to a front sight, which contains a keyhole opening that preferably passes through the adjustment element, through which the axle is inserted, wherein the adjustment element can be moved between two positions in relation to the axle inside the front sight support element with and against the spring force, such that the keyhole opening prevents a lateral movement of the front sight support element along the axle when it is engaged with the axle, and when it is released from the axle, allows the lateral adjustment of the front sight support element.

Aspect 2: The sight assembly according to Aspect 1, wherein the front sight support element (20) can pivot on a mount such that it can be folded up and down.

Aspect 3: The sight assembly according to either of the Aspects 1 and 2, wherein the keyhole opening is substantially formed by two geometric shapes, in particular a circular section with a straight section, and a rectangular section, wherein the diameter of the rectangular section is greater than the diameter of the straight section and the circular section.

Aspect 4: The sight assembly according to any of the Aspects 1 to 3, wherein the body of the axle has a profile that corresponds to the shape of the opening in the adjustment element, which is formed such that when the adjustment element is in the engaged position, a torque is generated that prevents lateral movement, and the lateral movement is allowed when in the adjustment element is in the released position.

Aspect 5: The sight assembly according to Aspect 4, wherein the profile on the axle is located on its outer circumference in the circumferential direction of the axle body.

Aspect 6: The sight assembly according to Aspect 4 or 5, wherein the profile on the axle is formed by at least two, preferably four recesses in the axle body extending in the axial direction of the axle.

Aspect 7: The sight assembly according to Aspect 6, wherein each recess forms a planar surface, and each planar surface is at 90° to its adjacent planar surfaces.

Aspect 8: The sight assembly according to Aspect 6 or 7, wherein adjacent recesses are separated along the circumference by outer surface sections of the axle body.

Aspect 9: The sight assembly according to Aspect 8, wherein the profile on the axle borders on threaded sections of the axle body in both axial directions, wherein the threaded sections correspond to threaded holes in the front sight support element.

Aspect 10: The sight assembly according to Aspect 8 or 9, wherein the outer surface sections forms a profile section that connects a first profile section to a second profile section such that a continuous threading is formed.

Aspect 11: The sight assembly according to any of the Aspects 1 to 10, wherein the front sight support element has a guide element for the adjustment element.

Aspect 12: The sight assembly according to any of the Aspects 1 to 11, wherein the spring element is braced against a bearing surface on the front sight support element and bears at its axial ends on a bearing surface on the second section of the adjustment element such that a force is exerted on the adjustment element in order to retain the front sight in a snapped-in or locked position.

Aspect 13: The sight assembly according to any of the Aspects 1 to 12, wherein the front sight is releasably connected to the front sight support element and can be transferred to a rotating position by pulling it against the spring force from its snapped-in position, in which a rotation of the front sight is prevented, to a position, in which the front sight can be rotated in order to adjust its height.

Aspect 14: The sight assembly according to any of the aspects 2 to 13, wherein the mount has a guide element that locks the adjustment element in place when the front sight support element is in the upright position and when it is folded-down.

Aspect 15: The sight assembly according to Aspect 14, in which the mount has a base with two opposing tabs that are substantially perpendicular to the surface of the base for receiving the axle for a pivotal support of the front sight support element, wherein the guide element is formed by a contact surface located between the tabs.

Aspect 16: The sight assembly according to Aspect 14 or 15, wherein the contact surface is at an angle to the base and/or parallel to the axle.

Aspect 17: The sight assembly according to any of the Aspects 14 to 16, in which the mount contains a dead stop for bracing the front sight support element when the front sight support element is folded down.

Aspect 18: The sight assembly according to any of the Aspects 1 to 17, wherein the mount is attached to or an integral part of a gas block.

Aspect 19: The sight assembly according to any of the Aspects 1 to 18, wherein the front sight support element contains: a first section for receiving a front sight; a second section connected to the first section for receiving the adjustment element releasably connected to the front sight, and the spring element, wherein there is at least one projection that extends radially inward located axially between the first and second sections, which forms a limit element for the front sight and a bearing surface for the spring element, wherein the projection is designed to allow the adjustment element to move axially inside the first and second sections of the front sight support element; and at least one threaded hole located in the second section for receiving an axle with a corresponding threading and for transferring the rotational movement of the axle to the front sight support element.

Aspect 20: The sight assembly according any of the Aspects 1 to 19, wherein a pulling of the front sight from its snapped-in position results in a movement of the hole in the adjustment element in relation to the axle such that the adjustment element can be moved from a torque-transferring connection to the axle into a connection to the axle in which torque is not transferred, for lateral adjustment of the front sight support element, and the lateral adjustment of the front sight support element when the connection does not transfer torque can be obtained through a turning of the axle, which is axially secured in place on the mount, wherein the rotational movement of the axle is transferred to the front sight support element by the threaded coupling between the axle and the front sight support element, such that it is moved laterally.

Aspect 21: The sight assembly according to any of the Aspects 2 to 20, wherein the second section of the adjustment element can be brought into contact with the ramp in the mount during the pivotal movement to flip the front sight support element up and down, such that the adjustment element can be moved against the force of the spring element, wherein when it comes in contact with the ramp, the adjustment element can move against the force of the spring element only to the extent that the torque-transferring connection between the axle and the front sight support element is maintained during the pivotal movement.

Aspect 22: An automatic firearm, in particular a machine gun or assault rifle, which is equipped with a sight assembly according to any of the Aspects 1 to 21.

What is claimed is:

1. A front sight support element for an adjustable flip up sight assembly, comprising:

a hollow body including:

a first section to receive a front sight, wherein the first section includes a first groove and a second groove that intersect at a right angle on an axial end of the first section, wherein the front sight is rotatable and can be placed in the first groove or the second groove;

a second section connected to the first section, the second section to receive an adjustment element to be releasably connected to the front sight and a spring element;

a projection extending radially inward and located axially between the first and second sections, wherein the projection provides a limit for the front sight and a bearing surface for the spring element, wherein the projection allows axial movement of the adjustment element inside the first and second sections; and a threaded hole in the second section to receive an axle including a corresponding threading and to transfer a rotational movement of the axle to the front sight support element.

2. The front sight support element according to claim 1, wherein the projection includes an annular shape, and has a bore through which the adjustment element can be inserted.

3. The front sight support element according to claim 2, wherein the second section includes a guide element on an axial end to receive the adjustment element.

4. The front sight support element according to claim 3, wherein the guide element is formed by slots on opposite sides of the second section that extend in an axial direction.

5. The front sight support element according to claim 4, further including two axially opposing threaded holes for receiving the axle and wherein the guide element is located axially between the opposing threaded holes.

6. The front sight support element according to claim 1, wherein the first groove and the second groove lock the front sight in place.

7. A firearm comprising:

a front sight support element for an adjustable flip up sight assembly, including:

a hollow body including:

a first section to receive a front sight, wherein the first section includes a first groove and a second groove that intersect at a right angle on an axial end of the first section, wherein the front sight is rotatable and can be placed in the first groove or the second groove;

a second section connected to the first section, the second section to receive an adjustment element to be releasably connected to the front sight and a spring element;

a projection extending radially inward and located axially between the first and second sections, wherein the projection provides a limit for the front sight and a bearing surface for the spring element, wherein the projection allows axial movement of the adjustment element inside the first and second sections; and a threaded hole in the second section to receive an axle including a corresponding threading and to transfer a rotational movement of the axle to the front sight support element;

the adjustment element contained within the front sight support element, which can be adjusted vertically and laterally in particular, the adjustment element comprising:

a first section of the adjustment element extending longitudinally; and a flat second section that is connected to the first section of the adjustment element, wherein the first section of the adjustment element releasably connects with the front sight, wherein the flat second section includes an opening through which the axle that supports the front sight support element may be inserted, wherein the opening produces a torque-transferring connection via a first geometry, and wherein the opening prevents the torque-transferring connection with the axle via a second geometry; and a guide element to lock the adjustment element in place.

8. The firearm according to claim 7, further including a base with two opposing tabs that are substantially perpendicular to a surface of the base for receiving the axle for pivotally supporting the front sight support element, wherein the guide element is formed by a contact surface located between the tabs.

9. The firearm according to claim 8, wherein the contact surface is at an angle to the base and the contact surface is parallel to the axle.

10. The firearm according to claim 9, wherein the contact surface is parallel to the axle.

11. The firearm according to claim 10, further including a dead stop for bracing the front sight support element when the front sight support element is folded down.

12. The firearm according to claim 11, wherein the front sight support element is attached to a gas block.

* * * * *